US010675743B2

(12) United States Patent
Jing

(10) Patent No.: US 10,675,743 B2
(45) Date of Patent: Jun. 9, 2020

(54) PASSIVE VIBRATION REDUCING APPARATUS

(71) Applicant: The Hong Kong Polytechnic University, Hung Hom, Kowloon (HK)

(72) Inventor: Xingjian Jing, Kowloon (HK)

(73) Assignee: The Hong Kong Polytechnic University, Kowloon (HK)

( * ) Notice: Subject to any disclaimer, the term of this patent is extended or adjusted under 35 U.S.C. 154(b) by 182 days.

(21) Appl. No.: 15/781,067

(22) PCT Filed: Jan. 31, 2018

(86) PCT No.: PCT/CN2018/074644

§ 371 (c)(1),
(2) Date: Jun. 1, 2018

(87) PCT Pub. No.: WO2018/153226

PCT Pub. Date: Aug. 30, 2018

(65) Prior Publication Data

US 2019/0283228 A1 Sep. 19, 2019

Related U.S. Application Data

(60) Provisional application No. 62/462,795, filed on Feb. 23, 2017.

(51) Int. Cl.
*B25D 17/04* (2006.01)

(52) U.S. Cl.
CPC .... *B25D 17/043* (2013.01); *B25D 2217/0073* (2013.01); *B25D 2250/371* (2013.01)

(58) Field of Classification Search
CPC ..... B25D 17/043; E21B 3/00; B23D 79/02
(Continued)

(56) References Cited

U.S. PATENT DOCUMENTS 2,165,904 A * 7/1939 Osgood ..... E21B 19/086 173/31
4,673,043 A * 6/1987 Greppmair ..... B25D 17/11 173/162.2

(Continued)

FOREIGN PATENT DOCUMENTS

CN 101906940 A 12/2010
CN 202100211 U 1/2012

(Continued)

OTHER PUBLICATIONS

Written Opinion/International Search Report received in International Patent Application No. PCT/CN/2018/074644, dated Apr. 26, 2018.

*Primary Examiner* — Nathaniel C Chukwurah
(74) *Attorney, Agent, or Firm* — Venable LLP; Henry J. Daley

(57) ABSTRACT

In an aspect of the disclosure there is provided a vibration reducing apparatus for a percussive tool having an axis of reciprocation. The apparatus comprises, a guide frame and at least one member extending across the axis of reciprocation. An assembly extending in a direction of along the axis of reciprocation comprises at least two layers and each layer comprises four interconnected elongate members pivotally attached and rotatable with respect to each other to define a polygon; and the assembly has at least one biasing means. A handle is movably coupled to the guide frame and supported on the assembly. The apparatus provides decreasing stiffness with increasing compression of the assembly under an applied load to the handle for reducing vibration in a predetermined frequency range.

25 Claims, 15 Drawing Sheets

(58) Field of Classification Search
USPC ..... 173/162.2, 162.1
See application file for complete search history.

(56) References Cited

U.S. PATENT DOCUMENTS

| | | | | |
|---|---|---|---|---|
| 5,095,600 | A * | 3/1992 | Allan | B25D 17/046 173/162.2 |
| 7,059,423 | B1 | 6/2006 | Hoggarth | |

FOREIGN PATENT DOCUMENTS

| | | | |
|---|---|---|---|
| CN | 104264541 | A | 1/2015 |
| CN | 205078197 | U | 3/2016 |
| JP | H11179680 | A | 7/1999 |

* cited by examiner (a). 2*KN* Input Force (b). 6*KN* Input Force (c). 10*KN* Input Force

PASSIVE VIBRATION REDUCING APPARATUS

This application is a U.S. National Stage Application under 35 U.S.C. § 371 of PCT/CN2018/074644, filed on Jan. 31, 2018, the entire content of which is hereby incorporated by reference, and claims the benefit of U.S. Provisional Application 62/462,795, filed Feb. 23, 2017.

FIELD

The present disclosure relates to an improved passive vibration reducing apparatus and system, particularly suited to suppressing vibration emitted by a reciprocating tool.

BACKGROUND

Vibration is a type of oscillation characterised by small, limited oscillations in a system in a near balanced state. In most aspects of engineering, because mechanical vibration affects mechanical properties, aggravates fatigue and wear, and can even cause the destruction of structures, such vibration is regarded as a negative factor which needs to be controlled.

Vibration transmitted to construction workers from the operation of various powered tools such as rammers, rock drills, demolition hammers, road breakers, hammer drills, chipping hammers or saws is an area where vibration has a significant health impact directly on the operators of the powered tools. It is known in the art that the vibration frequency range that humans perceive is from 1 to 1000 Hz, with humans most sensitive to vibration of 1-80 Hz. In particular, the most harmful vibration is in the frequency range between 6 Hz and 20 Hz. When construction workers firmly grasp the handles of powered tools for increased control and efficiency of such devices, local vibration is transmitted to the hands and arms of the user, as well throughout their body.

Local vibration can result in finger arterial contraction and reduction in grasping ability, with prolonged exposure to high levels of vibration by operating hand-held machines causing issues with normal circulation as well to nervous and musculoskeletal systems. A long period of high level vibration can serious damage to the human body, cause considerable pain and even result in permanent disability with frequency and intensity of vibration key contributing factors. This leads to a practical limit as to how long an operator can safely operate the equipment, which in turn has implications for the resources required to be allocated to specific tasks.

Vibration also affects the operation of large scale (often vehicle mounted) systems such as rock breakers. As is known by persons skilled in the art, the driving pistons of such machines are fired by nitrogen gas, hydraulic oil or a combination to strike the working tool which does the shattering, cracking or splitting of the material at the work site. Excessive vibration potentially impacts the operational life of components in such systems, and can lead to break down and decreased performance.

Typical traditional dampers have the same damping coefficient for all frequencies; with a higher damper having a smaller resonant peak; and a worse vibration amplitude at high frequencies; since the damper has very stiff and sticky for small vibration displacement. To properly provide vibration suppression; high damping is needed at the resonant frequency of the system; but a lower damping at other frequencies.

Particularly in the case of hand held machines, active damping mechanisms exist which include sensors for monitoring vibrations from a source, with some arrangement to generate an opposing force with the proper phase and amplitude sufficient to attenuate the vibration. However, most active damping mechanisms dramatically increase cost and weight and can affect overall performance of tools in which they are included.

Unfortunately, most traditional passive vibration dampening systems using traditional springs or dampers (particularly for hand held tools) do not suppress vibration as (1) the worker needs to press down to hold the machine tightly in order for high operational efficiency and (2) with more compression of traditional springs or materials, there is dramatically increasing stiffness and consequently significant reduction in the amount of vibration suppression provided.

SUMMARY

Features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims.

In accordance with a first aspect of the present disclosure, there is provided a vibration reducing apparatus for a percussive tool having a working member which reciprocates along an axis of reciprocation, the apparatus comprising:

a guide frame configured for retaining the percussive tool, the guide frame comprising at least two elements extending along and at least one member extending across the axis of reciprocation when the percussive tool is retained therein, an assembly extending in a direction of along the axis of reciprocation wherein said assembly comprises at least two layers, each layer comprising four interconnected elongate members pivotally attached and rotatable with respect to each other to define a polygon; wherein the assembly has at least one biasing means extending between the ends of at least one pair of elongate interconnected members of a layer and is displaceable in the direction of along the axis of reciprocation;

a handle movably coupled to the guide frame and supported on the assembly for transmission of an applied load down and along the assembly;

wherein the arrangement of the at least one biasing means relative to the elongate members provides decreasing stiffness with increasing compression of the assembly under an applied load to the handle for reducing vibration thereof in a predetermined frequency range.

The vibration reducing apparatus may comprise one or more further assemblies spaced apart from the assembly, wherein each assembly is attached at one end thereof to the at least one member extending across the axis of reciprocation.

One or more parameters of the or each assembly may be modified for achieving one or more of a lower natural resonance frequency relative to a percussive tool without the vibration reducing apparatus; increased loading capacity; a predetermined displacement distance of the at least one or more further assemblies along the axis of reciprocation and size of the at least one or more further assemblies in an unloaded state.

One or more of the modified parameters of the or each assembly may be selected from the group comprising spring stiffness, the angle between elongate members, the material of the elongate members, the ratio of lengths of elongate members to each other, and the number of layers.

The stiffness of the at least one biasing means may be adjustable for changing the resonant frequency of the apparatus.

The stiffness of the at least one biasing means may be adjusted by substitution with one or more biasing means having a different stiffness to the at least one biasing means.

The stiffness of the at least one biasing means may be adjusted by the addition or removal of one or more biasing means.

The angle between adjacent elongate members may be adjustable so as to modify the vibration suppression provided by the or each assembly.

The material of the elongate members may be selected so as to have a reduced stiffness relative to steel.

The material of the elongate members may be aluminium or magnesium.

Two or more elongate members of the apparatus have a first length; and the other elongate members of the apparatus have a second length; and the relative ratio of the first length to the second length may be selected to provide vibration suppression in the apparatus in the predetermined frequency range of 6-20 Hz.

The angle between the elongate members and/or the stiffness of biasing means may be adjustable so as to maintain the physical size of the apparatus with an increase in the applied load.

The elongate member angle and number of layers in the or each assembly may be adjusted so as to modify the possible amount of displacement of the or each assembly in the direction of along the axis of reciprocation.

The or each assembly may be attached to the guide frame at one or more regions distal to the ends of the guide frame for resisting non-vertical deformation under load.

The or each assembly may be configured to reduce vibration transmission from a percussive tool receivable therein in the predetermined frequency range of 6-20 Hz.

At least two of the elongate members may be pivotally interconnected with each other at a location distal from the ends thereof.

The maximum travel of the movably supported handle on the guide member may be fixed by stops on the guide frame.

The handle and at least one member extending across the frame may be adjustable so as to increase the distance between the at least one or more further assemblies and the at least one assembly.

The handle may be supported on the frame by a biasing means arranged to extend in a direction of along the axis of reciprocation of the working member of the tool.

The at least one member extending across the axis of reciprocation for retaining the powered percussive tool in the guide frame may be an adjustable clamp.

The lengths of elongate members may be substantially the same.

At least one pair of intersecting elongate members may be arranged asymmetrically about the axis of reciprocation.

The tool selected for retention in the guide frame may be selected from a group of percussive tools comprising a jackhammer, road breaker and hammer drill.

In accordance with a second aspect of the present disclosure, there is provided a vibration assembly of a vibration reducing apparatus for a percussive tool having an axis of reciprocation, the vibration assembly comprising:

at least two layers, each layer comprising four interconnected elongate members pivotally attached and rotatable with respect to each other to define a closed loop; the assembly being displaceable in the direction of along the axis of reciprocation and wherein the at least one assembly has at least one biasing means extending between the ends of at least one pair of elongate interconnected members of a layer;

wherein the assembly is configured for engagement with one element of a guide frame comprising at least two elements extending along the axis of reciprocation of the tool and at least one member extending across the axis of reciprocation wherein said at least one member is configured to retain the powered percussive tool in the guide frame;

wherein the assembly is configured for supporting at least one part of a handle movably coupled to the guide frame for transmission of force to the percussive tool and wherein the arrangement of the at least one biasing means relative to the elongate members provides decreasing stiffness with increasing compression of the assembly under an applied load to the handle for reducing vibration thereof in a predetermined frequency range.

In accordance with a third aspect of the present disclosure, there is provided a method of using the vibration reducing apparatus according to the first aspect with a tool selected from the group of percussive tools comprising a jackhammer, road breaker and hammer drill.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings.

Preferred embodiments of the present disclosure will be explained in further detail below by way of examples and with reference to the accompanying drawings, in which:—

DETAILED DESCRIPTION OF THE PREFERRED EMBODIMENTS

Various embodiments of the disclosure are discussed in detail below. While specific implementations are discussed, it should be understood that this is done for illustration purposes only. A person skilled in the relevant art will recognize that other components and configurations may be used without departing from the scope of the disclosure.

The disclosed technology addresses the need in the art for improved passive vibration apparatus, particularly suitable for use in reciprocating tools which are physically stabilised and maintained in the desired orientation for performing work by the grip of a construction worker.

In an aspect of the disclosure there is provided a frame having a pair of vibration reducing assemblies arranged in parallel; configured to provide beneficial nonlinear stiffness under compressive load for a vibration generating tool such as a jackhammer or road breaker supported within the frame. When the operator presses down the handles of the frame, more downward forces are added to the tool to increase operational efficiency. However, because of the beneficial vibration reducing characteristics of the vibration reducing assemblies, vibration is not transmitted to the hands of the operator. This can be compared to the nonlinear stiffness which would be provided if a vertically extending spring only was used; wherein increased downward pressure for efficiency in demolition or other operation would lead to more compression of the installed springs; and hence decreased vibration damping.

Figure 1A:
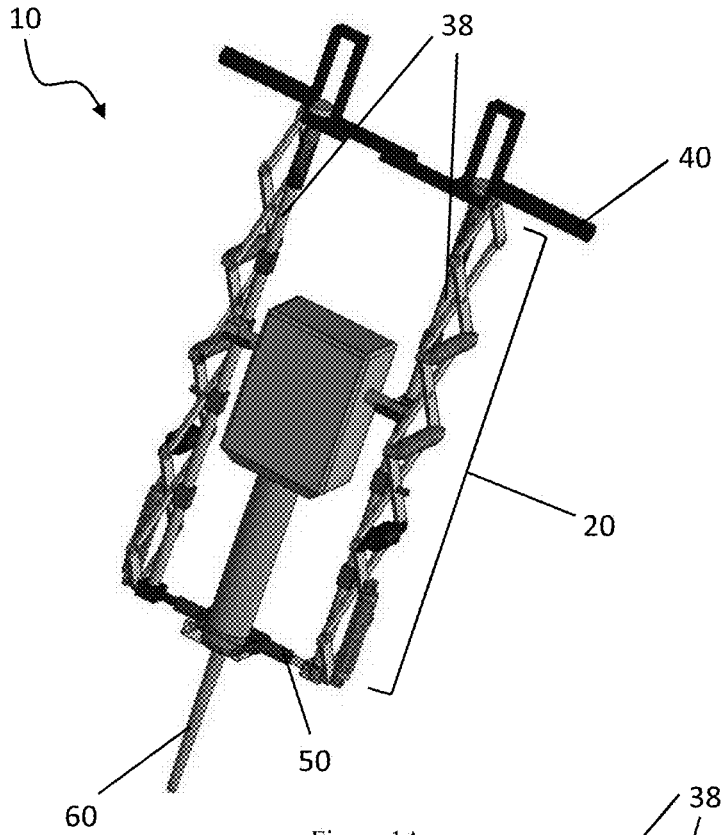
FIG. 1A shows a schematic representation of an embodiment of assemblies according to the present disclosure in which a jackhammer or road breaker is retained in the assembly.

Referring to FIG. 1A, there is depicted an exemplary vibration reducing apparatus 10 according to an embodiment of the present disclosure.

The vibration reducing apparatus 10 comprises a pair of vibration reducing assemblies 20 which support a handle 40 which is movable on a frame 38.

A member 50 extends across the frame 38 for supporting the lower portion of a percussive tool such as a jackhammer, road breaker, hammer drill or the like. The percussive tool has an axis of reciprocation along which the reciprocating member (e.g. the drill bit of the hammer drill, or the chisel of a jackhammer) moves back and forth.

Figure 1B:
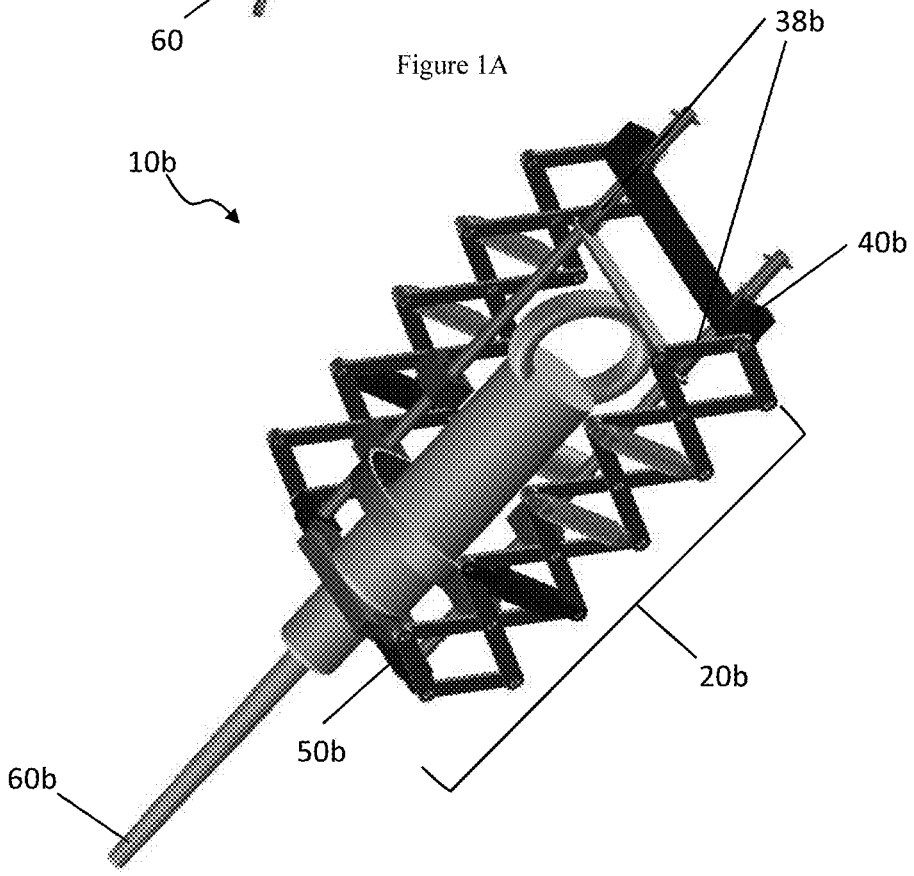
FIG. 1B depicts a further embodiment when a hammer drill is retained in the assembly.

Referring to FIG. 1B, there is depicted a further exemplary vibration reducing apparatus 10*b* according to a further embodiment of the present disclosure when a hammer drill 60*b* is connected to a frame 38*b* of the vibration reducing apparatus 10*b*.

The vibration reducing apparatus 10*b* comprises a pair of vibration reducing assemblies 20*b* which support a handle 40*b* which is movable on the frame 38*b*.

A member 50*b* extends across the frame 38*b* for supporting the lower portion of the hammer drill 60*b*. The hammer drill 60*b* has an axis of reciprocation along which the drill bit of the hammer drill 60*b* moves back and forth.

Mathematical Theoretical Modelling

Referring to FIG. 2A-FIG. 2G, various exemplary embodiments of the vibration reducing apparatus is shown. (In the embodiment depicted for the purposes of clarity there are no vertical aligned damping springs included, the handle has been omitted, and there is no depiction of the sliding attachment between the frame and the vibration assemblies.)

Figure 2A:
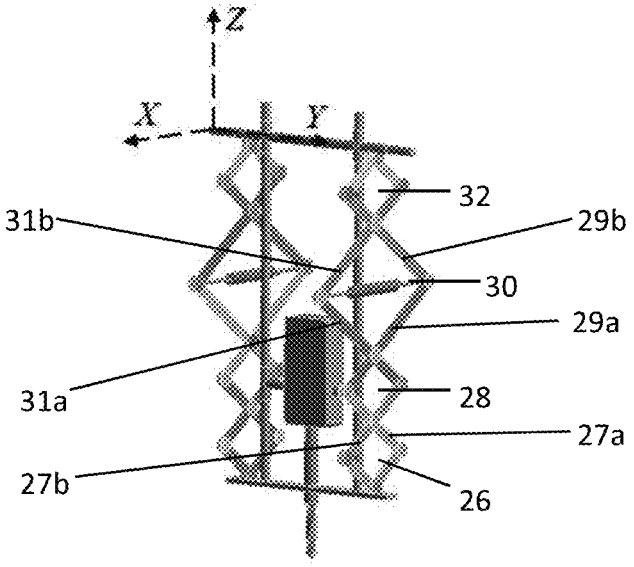
FIG. 2A depicts exemplary axes of reference included in the embodiment of disclosure depicted in FIG. 1A.

In the simplified version of the embodiment depicted in FIG. 2A, 4 "layers" 26, 28, 30,32 are shown.

Two elongate members 29*a*,29*b* of a predetermined length L2 intersect and are pivotally connected to elongate members having the same predetermined length 31*a*, 31*b* at a location other than the ends. Advantageously, the length of the elongate members 29*a*,29*b* are twice the length of the 27*a*, 27*b* of the other members enabling springs to be installed more easily as shown.

Figure 3A:
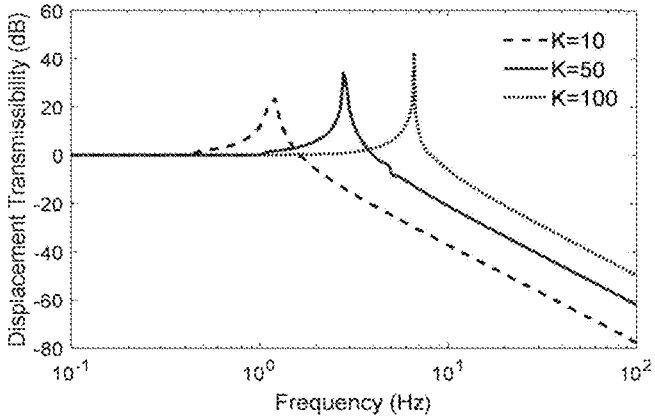
FIG. 3A depicts the displacement transmissibility with different spring stiffness.
Figure 3B:
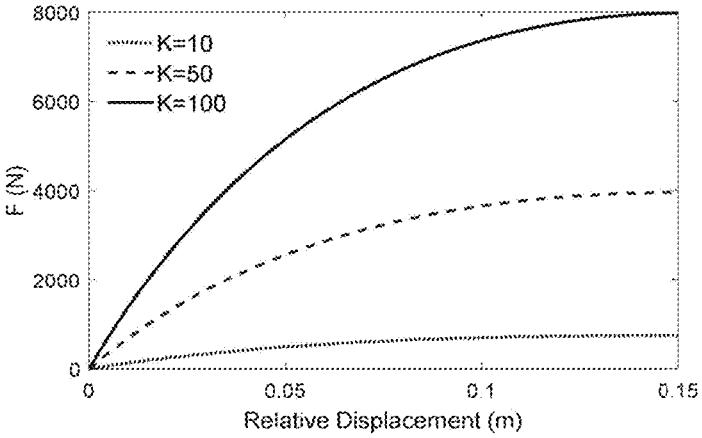
FIG. 3B depicts the static stiffness of the system in compression.

For modelling purposes, the breaker is considered as a rigid body $M_2$ and the two parallel vibration reducing structures are simplified into one for simplification purposes as depicted in FIG. 3B.

The vibration is exerted upward at the bottom of $M_2$.

The upper mass $M_1$ is to act as the added pushing-down force provided by the operator's hands. The elongate member weight of the vibration reducing structure can also be considered equivalently in the upper mass $M_1$.

Preferably the spring used is a standard linear spring with a stiffness K (or $K_n$ as the case may be).

Figure 2B:
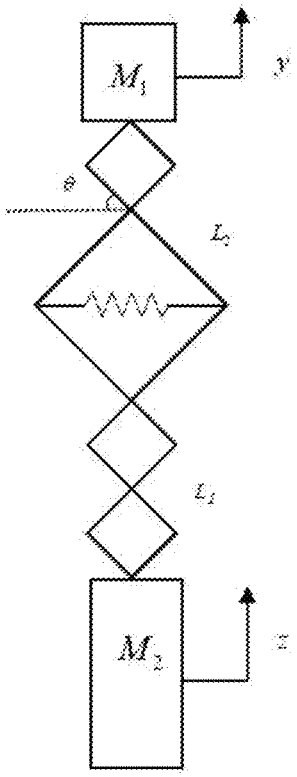
FIG. 2B depicts a schematic simplified system of one assembly of the exemplary embodiment depicted in FIG. 2A.
Figure 2C:
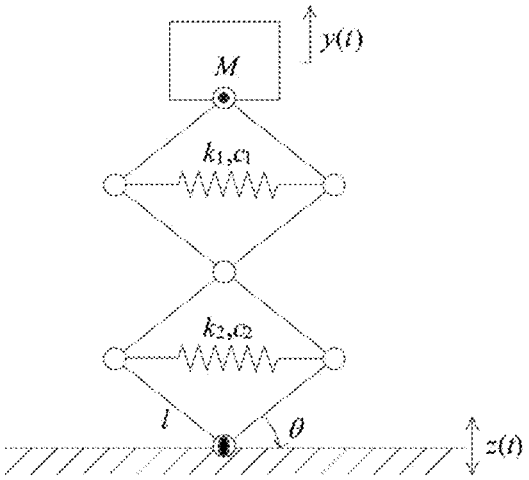
FIG. 2C depicts a schematic simplified system of a further single symmetric assembly having two layers.
Figure 2D:
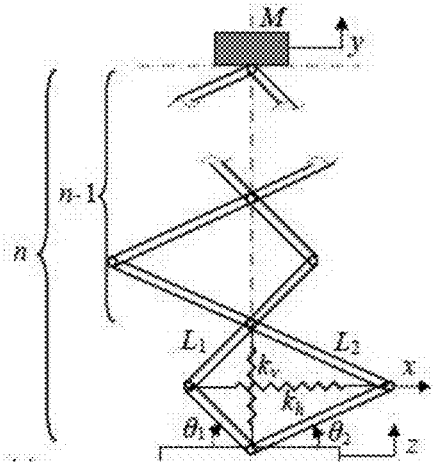
FIG. 2D depicts a schematic simplified n-layered asymmetric assembly.
Figure 2E:
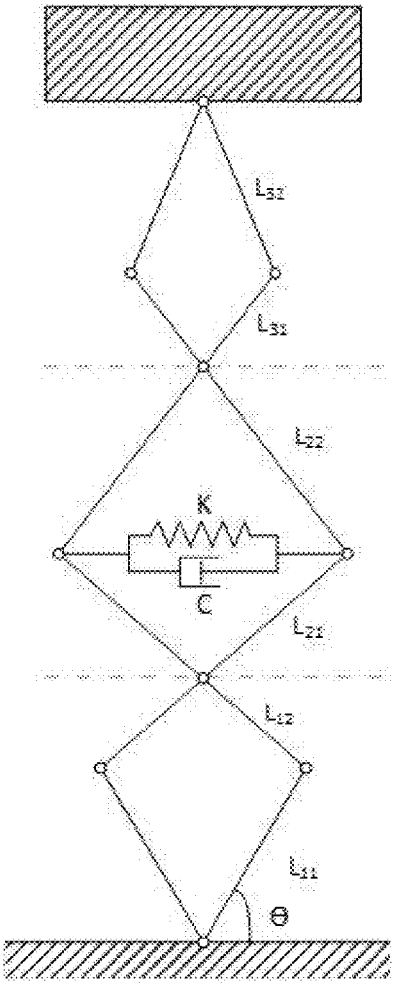
FIG. 2E depicts a schematic simplified three layered asymmetric assembly under central loading.
Figure 2F:
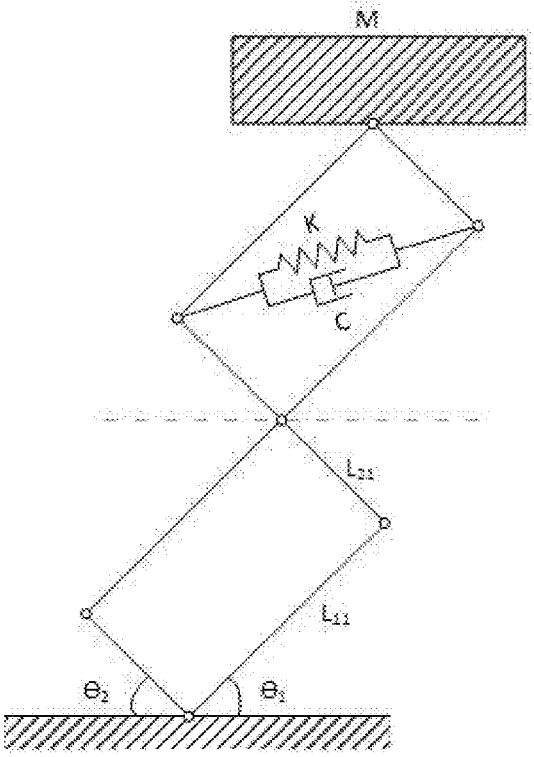
FIG. 2F depicts a schematic simplified two layered asymmetric assembly under off-centre loading conditions.

$L_1$ is the elongate member length of the small elongate members, and $L_2$ is the length of large ones in FIG. 2B, 2D. In the embodiment of FIG. 2C shown the members have the same length and are denoted by I. In FIGS. 2E, 2F, the members form a part of the specified layer as denoted by the subscripts e.g. $L_{31}$ is Layer 3 small member 1.

The assembly angle of elongate members with respect to the horizon line is represented by θ (see also FIG. 2B). The air damping effect is denoted by D with the corresponding damping coefficient is C. The involved parameters are listed in Table 1.

| Symbol | Structural Parameters | Unit |
|---|---|---|
| $M_1$ | Mass of Isolation Object | kg |
| $M_2$ | Mass of Vibration Source | kg |
| $M_x$ | Mass of each 100 mm Elongate member | kg |
| $L_1$ | Side Length of Small Structure | mm |
| $L_2$ | Side Length of Large Structure | mm |
| $R_L$ | Ratio of $L_2/L_1$ | / |
| n | Number of Layer | / |
| θ | Assembly Angle of Elongate member | rad |
| φ | Rotational Motion | rad |
| y | Absolute Motion of Isolation Mass | mm |
| ŷ | Relative Motion of Isolation Mass and Vibration Source | mm |
| z | Bottom Excitation | mm |
| a | Amplitude of Relative Motion ŷ | mm |
| $z_0$ | Amplitude of Bottom Excitation z | mm |
| φ | Phase of Relative Motion ŷ | rad |
| $\omega_0$ | Frequency of Bottom Excitation z | rad/s |
| $T_d$ | Displacement Transmissibility | / |
| $T_a$ | Acceleration Transmissibility | / |
| K | Spring Stiffness | N/mm |
| c | Damping Coefficient | / |
| D | Damping | / |
| f | Natural Frequency | Hz |

The absolute motion of the mass $M_1$ is denoted by y, the base excitation z, the rotation angle of each connecting elongate member φ, and the horizontal motion of the rotation joint in each layer of the smaller elongate member length is x. The positive direction of the motion y is in the upward direction. The length of the small elongate members $L_1$ is chosen as l and the length of the large elongate members $L_2$ is 2l as those in the real case.

Figure 2G:
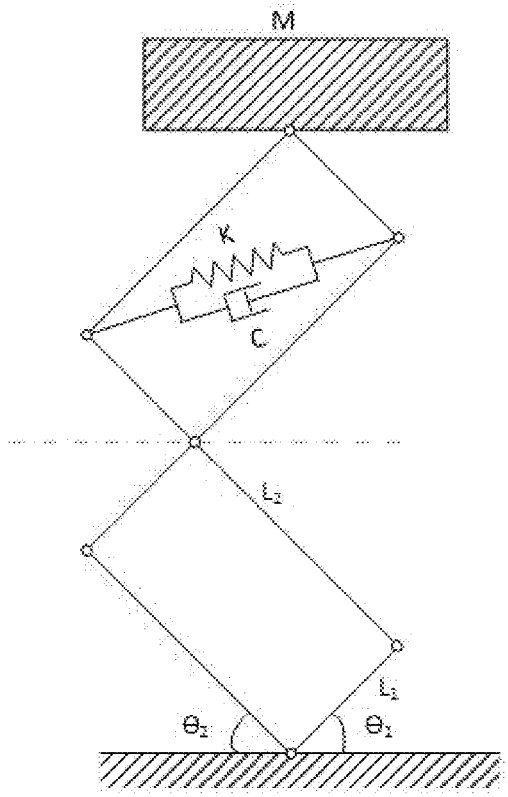
FIG. 2G depicts a schematic simplified two layered asymmetric assembly under off-centre loading conditions.
Figure 2H:
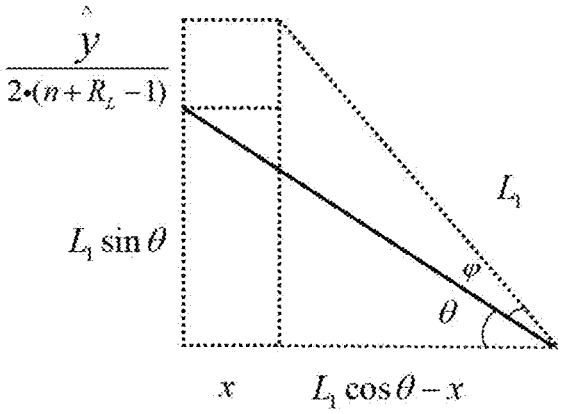
FIG. 2H depicts an exemplary mathematical coordinate system for motion of one elongate connecting member.

The rotation motion of each elongate member φ is shown in FIG. 2H. The elongate members can be designed to be much lighter in weight compared with the isolation mass, sufficiently short in length and strong in stiffness (via choosing materials, e.g., steel or aluminium alloy etc.) to reduce potential inertia or flexibility influence in dynamic response.

It can be seen that the rotational motion φ, and horizontal motion x can be expressed by relative motion ŷ. The ratio of $L_2/L_1$ is chosen as 2. The geometrical relation can be obtained as $$(l\cos(\theta)-x)^2+\left(l\sin(\theta)+\frac{\hat{y}}{2(n+1)}\right)^2=l^2 \tag{1}$$

$$\tan(\theta+\varphi)=\frac{\frac{\hat{y}}{2(n+1)}+l\sin(\theta)}{l\cos(\theta)-x} \tag{2}$$

$$\hat{y}=y-z \tag{3}$$

The transport motion φ and x are expressed as $$\varphi=\arctan\left(\frac{\frac{\hat{y}}{2(n+1)}+l\sin(\theta)}{l\cos(\theta)-x}\right)-\theta \tag{4}$$

$$x=l\cos(\theta)-\sqrt{l^2-\left(l\sin(\theta)+\frac{\hat{y}}{2(n+1)}\right)^2} \tag{5}$$

For convenience in discussion and for understanding dominant dynamic response of the system, the mass of the connecting elongate members are not considered in system modelling of this study.

The kinetic energy can be written as $$T=\tfrac{1}{2}M_1\dot{y}^2+\tfrac{1}{2}M_2\dot{z}^2 \tag{6}$$

The potential energy as $$V=\tfrac{1}{2}k_1(4x)^2 \tag{7}$$

Lagrange function expressed as $$L=T-V=\tfrac{1}{2}M_1\dot{y}^2+\tfrac{1}{2}M_2\dot{z}^2-\tfrac{1}{2}k_1(4x)^2 \tag{8}$$

The Lagrange principle is $$\begin{cases}\frac{d}{dt}\left(\frac{\partial L}{\partial \dot{y}}\right)-\frac{\partial L}{\partial y}=-D\\ \frac{d}{dt}\left(\frac{\partial L}{\partial \dot{z}}\right)-\frac{\partial L}{\partial z}=F_0\cos(\omega t)-D\end{cases} \tag{9}$$

where L is the Lagrange function expressed as L=T−V, D the dissipated energy for air damping. It can be obtained that $$D=c(\dot{y}-\dot{z}) \tag{10}$$

where c is the damping coefficient of the X-shaped structure.

By substituting kinetic energy, potential energy and transport motion into the Lagrange principle, the dynamic equation can be obtained as $$\begin{cases}M_1\ddot{y}+16k_lx\frac{\partial x}{\partial \hat{y}}\frac{\partial \hat{y}}{\partial y}=-c(\dot{y}-\dot{z})\\ M_2\ddot{z}+16k_lx\frac{\partial x}{\partial \hat{y}}\frac{\partial \hat{y}}{\partial z}=F_0\cos(\omega t)-c(\dot{y}-\dot{z})\end{cases} \tag{11}$$

Define $$f_1(\hat{y})=16k_lx\frac{\partial x}{\partial \hat{y}}\frac{\partial \hat{y}}{\partial y} \tag{12}$$

$$f_2(\hat{y})=16k_lx\frac{\partial x}{\partial \hat{y}}\frac{\partial \hat{y}}{\partial z} \tag{13}$$

where $$\frac{\partial x}{\partial \hat{y}} = \frac{\partial\left[l\cos(\theta) - \sqrt{l^2 - \left(l\sin(\theta) + \frac{\hat{y}}{2(n+1)}\right)^2}\right]}{\partial \hat{y}} = \frac{\hat{y} + 2(n+1)l\sin(\theta)}{4(n+1)^2\sqrt{l^2 - \left(l\sin(\theta) + \frac{\hat{y}}{2(n+1)}\right)^2}} \tag{14}$$

$$\frac{\partial \hat{y}}{\partial y} = \frac{y-z}{\partial y} = 1 \tag{15}$$

$$\frac{\partial \hat{y}}{\partial z} = \frac{y-z}{\partial z} = -1 \tag{16}$$

Substituting (12) and (13) into (11)

$$f_1(\hat{y}) = 4k_l x\frac{\hat{y} + 2(n+1)l\sin(\theta)}{(n+1)^2\sqrt{l^2 - \left(l\sin(\theta) + \frac{\hat{y}}{2(n+1)}\right)^2}} \tag{16}$$

$$f_2(\hat{y}) = -4k_l x\frac{\hat{y} + 2(n+1)l\sin(\theta)}{(n+1)^2\sqrt{l^2 - \left(l\sin(\theta) + \frac{\hat{y}}{2(n+1)}\right)^2}} \tag{17}$$

(16) and (17) can be expanded by Taylor series at zero equilibrium as $$F_1(\hat{y}) = \frac{f_1(0)}{0!} + \frac{f_1'(0)}{1!}\hat{y} + \frac{f_1''(0)}{2!}\hat{y}^2 + \frac{f_1'''(0)}{3!}\hat{y}^3 + \frac{f_1''''(0)}{4!}\hat{y}^4 + o = \beta_1\hat{y} + \beta_2\hat{y}^2 + \beta_3\hat{y}^3 + \beta_4\hat{y}^4 \tag{18}$$

-continued $$F_2(\hat{y}) = \frac{f_2(0)}{0!} + \frac{f_2'(0)}{1!}\hat{y} + \frac{f_2''(0)}{2!}\hat{y}^2 + \frac{f_2'''(0)}{3!}\hat{y}^3 + \frac{f_2''''(0)}{4!}\hat{y}^4 + o = \alpha_1\hat{y} + \alpha_2\hat{y}^2 + \alpha_3\hat{y}^3 + \alpha_4\hat{y}^4 \tag{19}$$

where $$\beta_1 = \frac{4k_l\tan^2(\theta)}{(n+1)^2} \tag{20}$$

-continued $$\beta_1 = \frac{3k_l\sin(\theta)}{l(n+1)^3\cos^4(\theta)} \tag{21}$$

$$\beta_3 = -\frac{k_l(4\cos^2(\theta) - 5)}{2l^2(n+1)^4\cos^6(\theta)} \tag{22}$$

$$\beta_4 = -\frac{5k_l(4\cos^2(\theta) - 7)\sin(\theta)}{16l^3(n+1)^5\cos^8(\theta)} \tag{23}$$

$$\alpha_1 = -\frac{4k_l\tan^2(\theta)}{(n+1)^2} \tag{24}$$

$$\alpha_1 = -\frac{3k_l\sin(\theta)}{l(n+1)^3\cos^4(\theta)} \tag{25}$$

$$\alpha_3 = \frac{k_l(4\cos^2(\theta) - 5)}{2l^2(n+1)^4\cos^6(\theta)} \tag{26}$$

$$\alpha_4 = \frac{5k_l(4\cos^2(\theta) - 7)\sin(\theta)}{16l^3(n+1)^5\cos^8(\theta)} \tag{27}$$

Substituting the Taylor series expansion (16)-(19) into (15) as $$\begin{cases} M_1\ddot{\hat{y}} + c\dot{\hat{y}} + M_1\ddot{z} + \beta_1\hat{y} + \beta_2\hat{y}^2 + \beta_3\hat{y}^3 + \beta_4\hat{y}^4 = 0 \\ M_2\ddot{z} + c\dot{\hat{y}} + \alpha_1\hat{y} + \alpha_2\hat{y}^2 + \alpha_3\hat{y}^3 + \alpha_4\hat{y}^4 - F_0\cos(\omega t) = 0 \end{cases} \tag{28}$$

where $\ddot{y}=\ddot{\hat{y}}+\ddot{z}$.

Using the Harmonic Balance Method (HBM) for theoretical results. The solution of (21) can be set as $$\hat{y}=a_0+a\cos(\omega t+\varphi_1) \tag{29}$$

$$z=b_0+b\cos(\omega t+\varphi_2)$$

where $a_0$ and $b_0$ is the bias term, a and b is the amplitude of harmonic terms.

$$\begin{cases} a_0^3\alpha_3 + \frac{1}{2}a^2\alpha_2 + a_0\alpha_1 + \frac{3}{8}a^4\alpha_4 + a_0^4\alpha_4 + \frac{3a^2a_0\alpha_3}{2} + 3a^2a_0^2\alpha_4 + a_0^2\alpha_2 = 0 \\ \left(-3aa_0^2\alpha_3 - a\alpha_1 - \frac{3}{4}a^3\alpha_3 - 4aa_0^3\alpha_4 - 2aa_0\alpha_2 - 3a^3a_0\alpha_4 - ca\omega\right)\sin(\varphi_1) + M_2b\omega^2\sin(\varphi_2) = 0 \\ \left(a\alpha_1 + \frac{3}{4}a^3\alpha_3 + 4aa_0^3\alpha_4 + 2aa_0\alpha_2 + 3a^3a_0\alpha_4 + 3aa_0^2\alpha_3 - ca\omega\right)\cos(\varphi_1) - M_2b\omega^2\cos(\varphi_2) - F_0 = 0 \\ a_0^3\beta_3 + \frac{1}{2}a^2\beta_2 + a_0\beta_1 + + \frac{3}{8}a^4\beta_4 + a_0^4\beta_4 + \frac{3a^2a_0\beta_3}{2} + 3a^2a_0^2\beta_4 + a_0^2\beta_2 = 0 \\ \left(-4aa_0^3\beta_4 - 2aa_0\beta_2 - 3aa_0^2\beta_3 + M_1a\omega^2 - \frac{3}{4}a^3\beta_3 - a\beta_1 - 3a^3a_0\beta_4 - ca\omega\right)\sin(\varphi_1) + M_1b\omega^2\sin(\varphi_2) = 0 \\ \left(-M_1a\omega^2 + \frac{3}{4}a^3\beta_3 + a\beta_1 + 3a^3a_0\beta_4 + 4aa_0^3\beta_4 + 2aa_0\beta_2 + 3aa_0^2\beta_3 - ca\omega\right)\cos(\varphi_1) - M_1b\omega^2\cos(\varphi_2) = 0 \end{cases} \tag{30}$$

The displacement transmissibility $T_d$ can be obtained as $$T_d = \left|\frac{\sqrt{a^2 + b^2 + 2ab\cos\varphi_1}}{b}\right| \tag{31}$$

The structural parameters of the system can be designed for different vibration isolation performance. In the theoretical calculations shown the parameters including spring stiffness, mass of isolation object, assembly angle of elongate members and the damping ratio are considered as structural parameters for different vibration isolation performance, with the elongate members mass being neglected.

The displacement transmissibility and the natural frequency calculated according to equation 31 demonstrates the vibration isolation effect with a series of different structural parameters.

It would be appreciated that similar analyses could be conducted of the systems depicted in FIG. 2C (two layer symmetric structure), FIG. 2D (n layer asymmetric structure), FIG. 2E (thee layer asymmetric structure having a first form), FIG. 2F (two layer asymmetric structure having a second form), FIG. 2G (two layer asymmetric structure having a third form).

In FIGS. 2C-2G, "o" represents a rotation joint. K, $k_1$,$k_2$,$k_v$ and $k_h$ are stiffness coefficients of corresponding springs. C, $c_1$, and $c_2$ are damping coefficients of corresponding dampers As can be seen with reference to these figures in particular, the springs could be vertically installed between the two joints which are used supplementary for removing negative stiffness within the system, which can be seen in FIG. 1A.

However, the springs are innovatively used in horizontal ways as shown, which provide the main spring force. The dampers are mainly installed horizontally to create the claimed desired nonlinear damping and vertical dampers are not needed but can be used for increasing damping in case that it needed. Both linear and nonlinear springs and dampers of any appropriate type can be used with similar performance.

As is discussed further in more detail there are no specific requirements on the number of sections/layers. Generally, more layers leads to smaller dynamic stiffness, smaller damping effect and more linear effect both in equivalent stiffness and damping. Conversely, with fewer layers, this will lead to a larger dynamic stiffness, larger damping effect and more non-linear effect both in equivalent stiffness and damping.

The length of a section/layer is determined by the member length, while a longer member length leads to smaller and more linear damping effect and has a mild effect on stiffness. A bigger assembly angle leads to larger loading capacity and bigger dynamic stiffness and vice versa. (see FIG. 2C).

The rod length of the same layer or different layer can be different to produce asymmetric shaped structure, as shown in FIG. 2C-2G with similar or even better performance in stiffness and damping effects.

As for the springs, a bigger spring constant leads to larger loading capacity and bigger stiffness with respect to the same compression or extension. Importantly, the springs can be any type (air springs, coil springs, materials or others), and linear or nonlinear, which are used to provide elastic force, but mainly installed in the horizontal way with a vertical supplement (as shown in FIG. 1) to remove negative stiffness.

The detailed spring constants are determined such that after installation the working position should optimally have a 90 degree at the middle of the X-shaped structures, as is analysed in more detail below.

Further to the above, the following parameters are considered, especially in relation to the embodiment depicted in FIGS. 2A, 2B and the geometric parameters of FIG. 2H.

(a) Effect of Spring Stiffness K

Figure 4A:
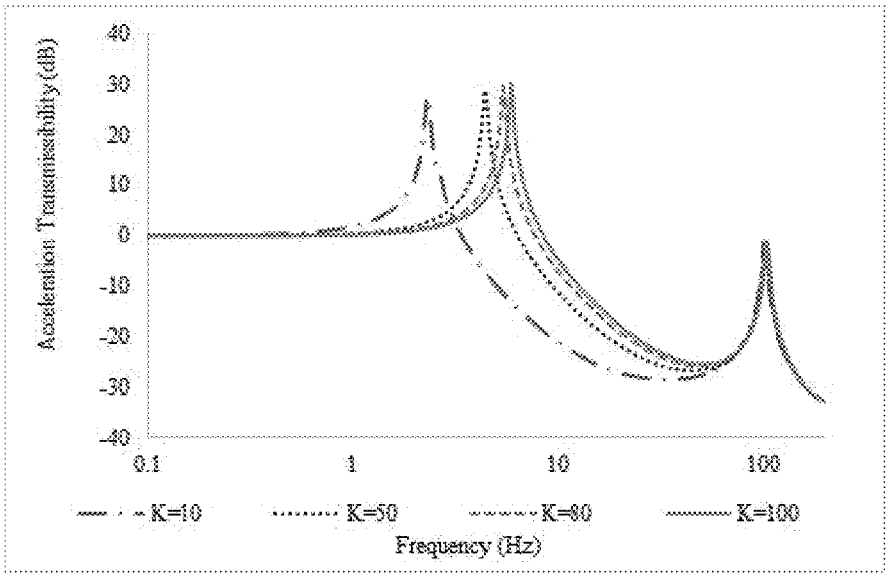
FIG. 4A depicts the acceleration transmissibility with different spring stiffness.

FIG. 4*a* shows that the vibration isolation effect is influenced by the spring stiffness. It can be seen that decreasing the spring stiffness can reduce the peak value of the displacement transmissibility and the resonant frequency of the system.

When the spring stiffness decreases from 100 to 10, the resonant frequency decreases from 6.8 Hz to 1.2 Hz. This relationship demonstrates that reducing the spring stiffness improves the vibration suppression performance.

With the same springs to support the same mass $M_1$ without the X-shaped structure, it has been calculated that the resonant frequencies would be 5.1 Hz, 11.3 Hz, and 16.1 Hz respectively.

This may be compared with the resonance frequencies obtained when the system includes the X-shaped structures (1.2 Hz, 2.8 Hz, and 6.8 Hz), demonstrating mathematically that the resonant frequencies are significantly reduced, clearly showing the advantageous quasi-zero-stiffness property of the X-shaped structure in dynamic vibration isolation as compared to that provided by traditional spring arrangements.

To have more understanding, the static stiffness of the structure is developed as follows and shown in FIG. 4B with different stiffness value for K.

Considering the given initial mass $M_1$, the structure is at equilibrium with initial spring force $$F_0 = \frac{M_1 g}{5\tan\theta}$$

and then a force F is applied downward, $$F=5(F_0+Kx)\tan(\theta-\varphi)-Mg \tag{32a}$$

Considering the relationship between x and relative displacement $\hat{y}$, $$F = 5\left(\frac{M_1 g}{5\tan\theta_0} + K\left[l\cos(\theta) - \sqrt{l^2 - \left(l\sin(\theta) + \frac{\hat{y}}{10}\right)^2}\right]\right) \frac{l\sin\theta - \frac{\hat{y}}{5}}{2l\cos\theta - \sqrt{l^2 - \left(l\sin(\theta) + \frac{\hat{y}}{10}\right)^2}} - M_1 g \tag{32b}$$

It can be seen clearly from FIG. 3B that the stiffness of the structure actually decreases as the suppression of the structure (i.e., the absolute relative displacement between $M_1$ and $M_2$ is increased).

This shows that when more downward force is applied to the handles:

- the working position for the operator is lower;
- there is more compression of the frame structure;
- the structure has a decreasing dynamic stiffness, which is very beneficial to vibration control.
- there is a higher demolition efficiency as the operator is applying more force.

This again demonstrate the unique nonlinear advantages of the structure compared with all other traditional vibration suppression systems.

(b) Effect of Increased Mass $M_1$

With other parameters set to $L_1$=100, $L_2$=200, $M_2$=19.68, K=100, $\theta=\pi/4$, and the same elongate member material, the upper mass $M_1$ can be changed to different values to examine how the downward force at the vibration reducing apparatus handles can affect the vibration transmission. The curves of displacement transmissibility $T_d$ are shown in FIG. 4*c*, where it can be seen that increasing the mass $M_1$ can decrease the resonant frequency, while at the same time providing a reduced peak value.

It should be emphasized that for a pure linear system, when increasing the mass but maintaining the same spring stiffness, the resonant frequency would be decreased as $$\sqrt{\frac{K}{20}} \Big/ \sqrt{\frac{K}{10}} \approx 0.7$$

However, with the vibration reducing apparatus of the present disclosure, the resonance frequencies are decreased as 3.5/6.8≈0.5, which is much smaller than compared to a pure linear system.

This once again proves that the vibration reducing apparatus has beneficial nonlinear stiffness property which offers a smaller stiffness with increase of the downward force (the latter leads to more compression of the structure).

(c) Effect of Elongate Member Assembly Angle θ

The other parameters are set to the same as $L_1$=100, $L_2$=200, $M_1$=9.85, $M_2$=19.68, K=100, while the elongate member assembly angle is considered as π/6, π/4 and π/3. The displacement transmissibilities $T_d$ are shown in FIG. 3D.

Figure 3C:
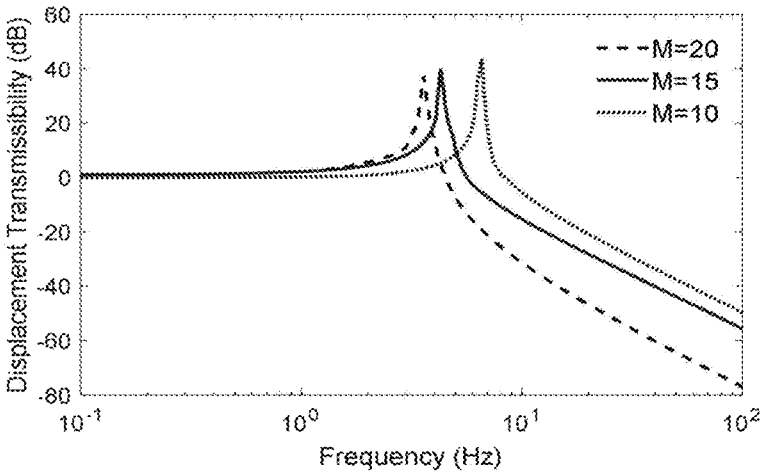
FIG. 3C depicts displacement transmissibility of different $M_1$.
Figure 3D:
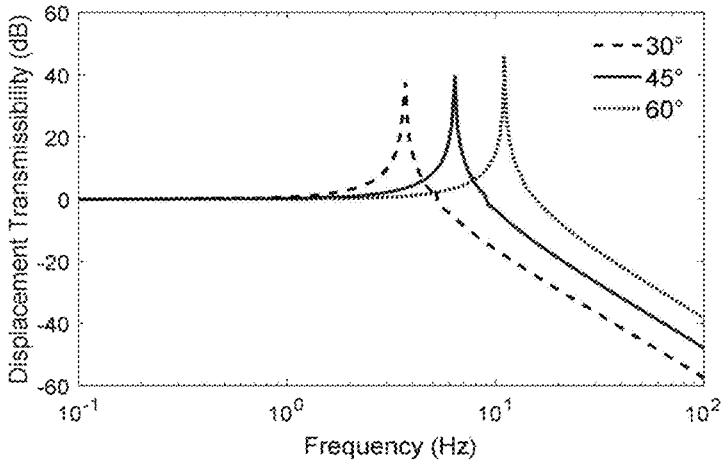
FIG. 3D depicts the displacement transmissibility of different elongate member assembly angle.

We can see from FIG. 3D that, the resonant frequency becomes smaller when the assembly angle changes from 60° to 30°. It demonstrates again that the vibration isolation performance becomes better with more compression within the structure, i.e. the decrease of angle θ, tending to be a quasi-zero-stiffness property.

Therefore, assembly angle of the elongate members is a critical parameter to reduce the vibration transmission from the percussive tool to operators' hands and arms (d) Effect of Damping c With the same parameter setting as before but θ=π/4 and different damping coefficient c, the transmissibilities are shown in FIG. 43E which shows that the peak value is decreased with an increase of the damping coefficient.

FEM analysis of the dynamic response of the structure

FEM analysis was performed to understand more about the structural dynamics of the structure with respect to each critical parameter. In the finite element analysis, some parameters are fixed as $M_2$=19.68, $M_x$=0.03 (elongate member mass of $L_1$-type), D=0.01 (equivalent damping), $L_1$=100, $L_2$=200, $M_1$=9.85, θ=π/4, and the elongate member material is structural steel.

The input excitation can adopt a force of sweeping frequency and with amplitude 1000N exerted at the bottom of the mass $M_2$ which is similar to the real working situation of a road breaker. It is easy to obtain the acceleration transmissibility $T_a$ of the response of the structure together with the road breaker to reflect the vibration isolation effect with different structural parameters.

(a) Effect of Spring Stiffness K

With the structural parameters mentioned above, and choosing different spring stiffness, the curves of acceleration transmissibility $T_a$ are shown in FIG. 54A.

It can be seen that whatever the spring stiffness is, the curves of acceleration transmissibility are similar to the result of theoretical calculation.

The vibration isolation effect of the system is obviously influenced by the spring stiffness, which is consistent with the theoretical analysis in FIG. 43A. For example, in FIG. 54A, for K=100, the resonant frequency is 5.9 Hz, but for K=50, it reduces to 4.5 Hz.

This shows that reducing the spring stiffness is effective to reduce the resonant frequency and thus improve the vibration suppression performance. Moreover, all transmissibility curves have a second peak at around 104.6 Hz due to the resonant frequency of the mass $M_2$, i.e., the road breaker itself. This is consistent with the actual experimental results later, also corresponding to the second mode frequency of the structure.

(b) Effect of Mass $M_1$

It should be noted that the Mass $M_1$ is used to simulate the downward force exerted on the structure handle. The bigger the mass $M_1$, the more downward force and thus more compression on the structure. With the same structural parameters as before, the mass $M_1$ is chosen as 15.7 and 9.85 respectively and the curves of acceleration transmissibility $T_a$ are shown in FIG. 4C.

It can be seen that increasing the mass $M_1$ decreases the peak frequency which is particularly important to the vibration suppression at the structures' handles; however, the second peak is basically not changed since it is only dependent on the materials and structures of the road breaker. This is consistent with the theoretical analysis before in FIG. 3C.

Therefore, the downward force on the structure is critical for vibration suppression. As discussed before, the downward force would lead to the increase of the stiffness in traditional spring systems resulting in worse vibration suppression. However, the structure of the present disclosure provides an excellent nonlinear stiffness property which can present higher vibration suppression and higher demolition efficiency due to the increased downward force simultaneously.

(c) Effect of Elongate Member Assembly Angle θ

Figure 4B:
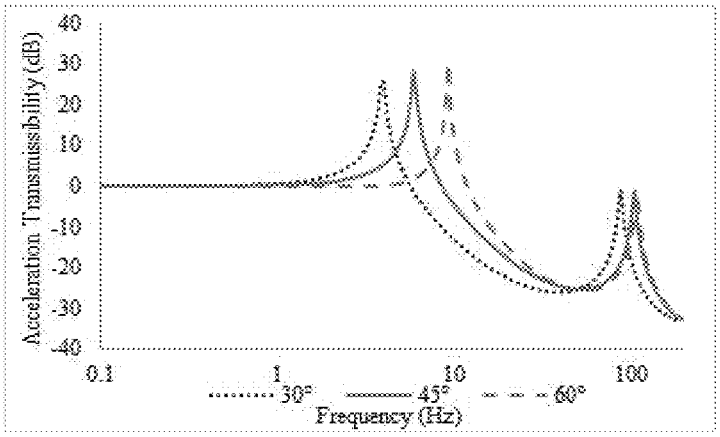
FIG. 4B depicts the acceleration transmissibility with different $M_1$.
Figure 4C:
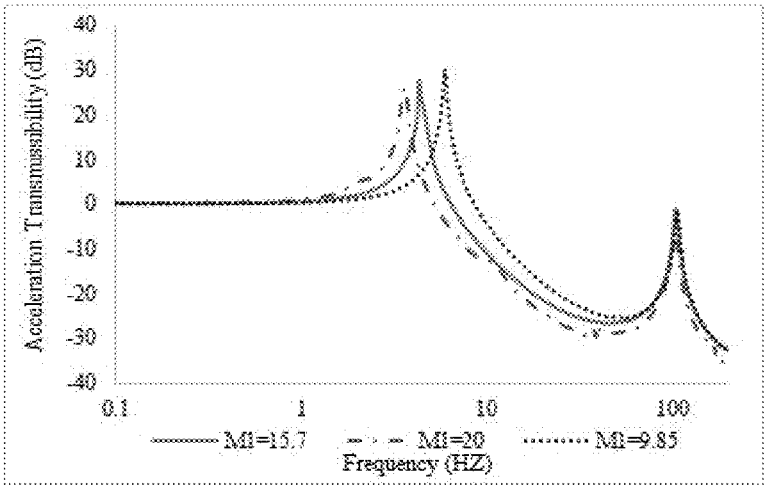
FIG. 4C depicts the acceleration transmissibility with different elongate member assembly angle.

With the other parameters the same as before and tuning the assembly angle θ the curves of $T_a$ for different assembly angle are shown in FIG. 4B.

It can be seen that the frequencies of the two peaks both become smaller when reducing the assembly angle; due to the decrease of the structural stiffness of the structure.

It demonstrates that the vibration isolation performance becomes better with the decrease of angle θ tending to become a quasi-zero-stiffness property as discussed. This is consistent with the theoretical analysis in FIG. 43D.

Hence, the assembly angle of the elongate members in the structure is a critical parameter to reduce vibration frequencies with between 20-30 degrees determined to provide good vibration suppression performance.

(d) Effect of Damping D

Figure 4D:
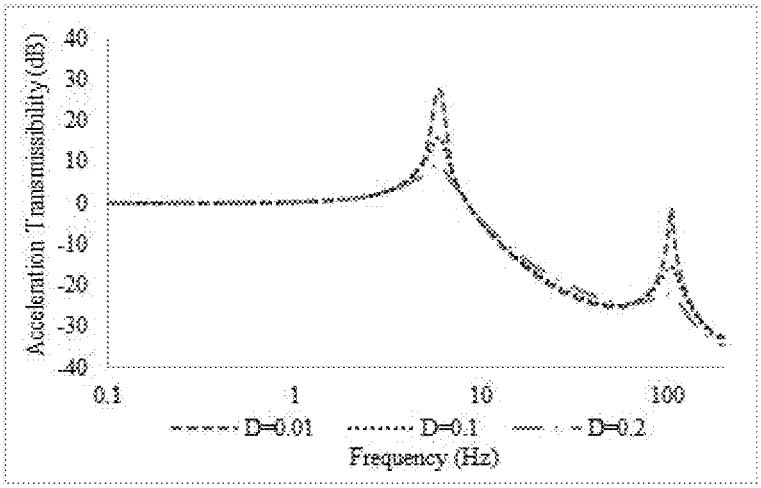
FIG. 4D depicts the acceleration transmissibility with different damping.

With the same parameter setting but different damping D, the transmissibility curves are shown in FIG. 4D.

Figure 3E:
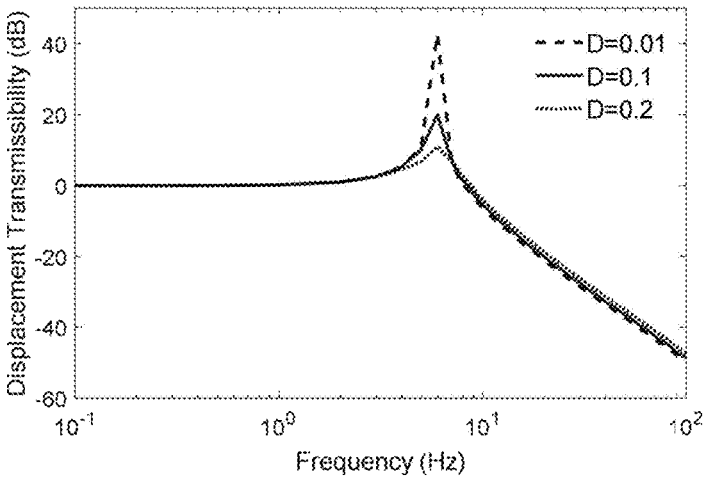
FIG. 3E depicts the displacement transmissibility of different damping.

Increase of the damping can effectively reduce the resonant peak values. This is similar to the results in the theoretical analysis in FIG. 3E. However, increasing the damping ratio will also increase the amplitude of acceleration transmissibility in the frequency range between 10 Hz and 100 Hz.

(e) Effect of Elongate Member Material

Figure 4E:
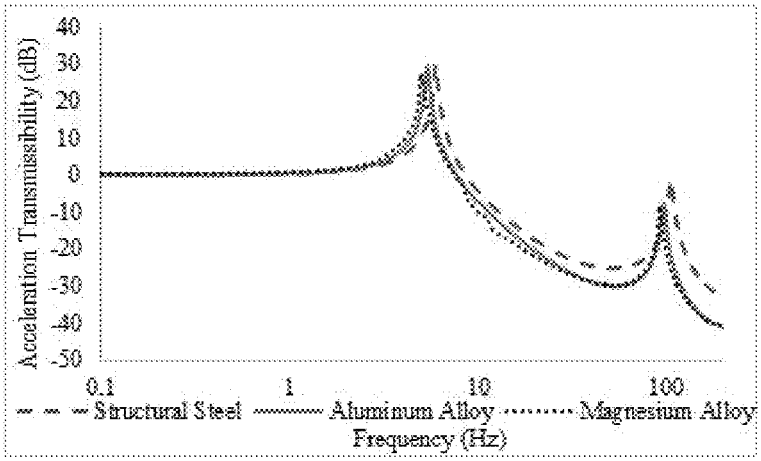
FIG. 4E depicts the acceleration transmissibility of different elongate member material.

The elongate member materials can be chosen to see potential influence in the FEM analysis. With the same parameter setting but choosing different material for all elongate members, the curves of acceleration transmissibility are shown in FIG. 4E.

It is seen that changing materials can affect the curves of vibration transmissibility, and especially for high frequency vibration the aluminium or magnesium elongate member has much smaller transmissibility than that of steel elongate members, due to the smaller stiffness of the materials. This is an important design factor since different materials will also influence the overall weight of the structure and its handling comfort in practice.

(f) Effect of Ratio $L_1/L_2$

Figure 4F:
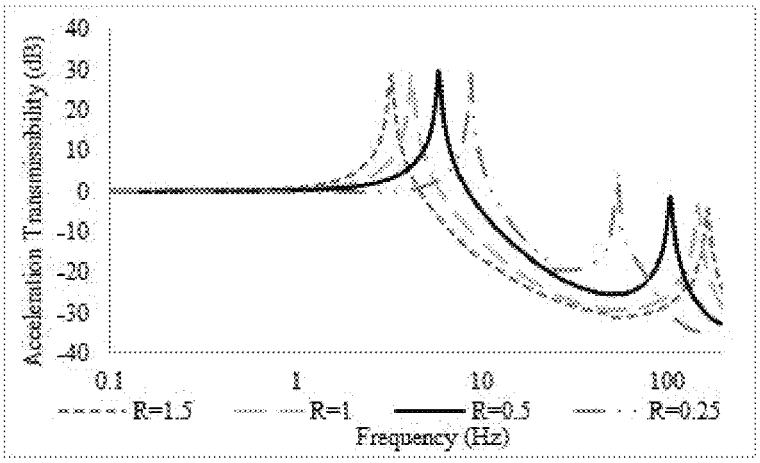
FIG. 4F depicts the acceleration transmissibility with different $L_1/L_2$.

Different elongate member length ratio can be freely changed in the FEM analysis, which would create different asymmetric structure. With the same parameter setting but $L_1$=100 mm and different ratio of $L_1/L_2$, the curves of $T_a$ are shown in FIG. 4F.

It can be seen that with the decrease of the ratio from 1.5 to 0.25, the first resonant frequency is increasing continuously while the second resonant frequency is decreasing accordingly. Considering that the sensitive vibration to hands and arms are the frequency from 6 Hz to 20 Hz a larger elongate member length ratio is obviously better than a smaller elongate member length ratio.

(g) Effect of Layer Number n

Figure 4G:
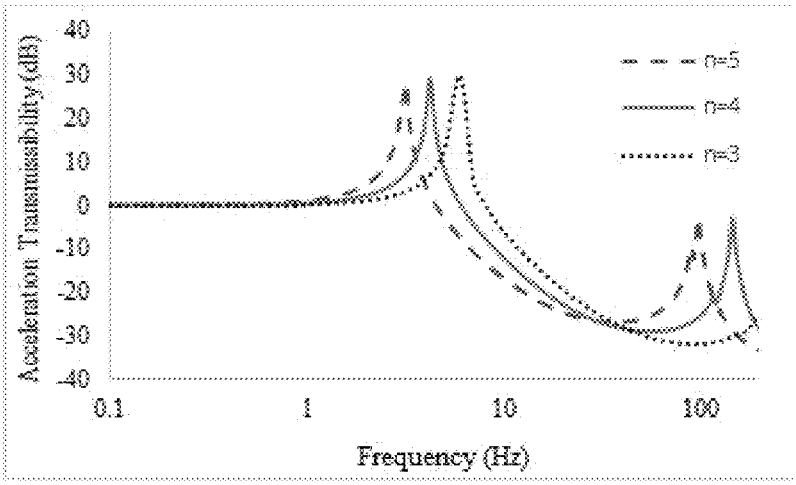
FIG. 4G depicts the acceleration transmissibility of different layer n.

With the other parameters set to the same as before but changing different n, the curves of acceleration transmissibility are shown in FIG. 4G.

It is clear that the layer number is also an important factor for the vibration isolation effect, and both the two resonant frequencies are decreasing with increasing the layer number, which is very helpful for the vibration isolation performance.

Therefore, we can improve the vibration isolation effect though increasing the number of layers, but an increasing layer number leads to a bigger size of the structure.

Refining Design of Structural Parameters

It can be seen above that different structural parameters affect the vibration suppression effect of the vibration reducing assemblies of the present disclosure. Therefore, it is important to refine the parameters to improve performance for specific size, weight, and vibration frequency of a percussive tool.

In practice, there are usually not too many choices for the size and materials of the apparatus/system of the present disclosure since the size of the specific percussive tools is generally consistent in the market with similar weight and vibration frequency. However, some parameters of the vibration reducing assembly such as the spring stiffness, the working angle θ, and materials etc. could be modified.

Therefore, in this section, based on the comparison analysis of different parameters in the previous sections, a relatively better parameter setting is determined for a system, which can achieve much better vibration suppression effect considering the sensitive frequency range 6-20 Hz.

Selection of Appropriate Parameters

Considering that the first two resonant frequencies are critical to the vibration suppression performance in the frequency range 6-20 Hz, a summary of the influence of various parameters in relation to vibration suppression performance is given below.

TABLE 2

A summary of influence arising from adjustment of parameters

| | The 1st resonance | | The 2nd resonance | | Transmissibility |
|---|---|---|---|---|---|
| | frequency | peak | frequency | peak | in 6-20 Hz |
| $M_1$ ↑ | ↓↓ | — | = | = | ↓↓ |
| Stiffness K ↑ | ↑↑ | ↑ | = | = | ↑↑ |
| Assembly angle θ ↓ | ↑↑ | ↑ | ↑ | — | ↑↑ |
| Length ratio ($L_1/L_2$) ↑ with fixed $L_1$ = 100 mm | ↓↓ | — | ↑↑ | ↓ | ↓↓ |
| Layer number n ↑ | ↓↓ | ↓ | ↓↓ | ↓ | ↓↓ |
| Damping effect ↑ | = | ↓ | = | ↓ | ↑ |

TABLE 2-continued

A summary of influence arising from adjustment of parameters

| | The 1st resonance | | The 2nd resonance | | Transmissibility |
|---|---|---|---|---|---|
| | frequency | peak | frequency | peak | in 6-20 Hz |
| Materials from steel, to aluminium to magnesium | ↓ | ↓ | ↓ | ↓ | ↓ |

From Table 2, the following points can be concluded.

(a) In general, all structural parameters present a monotonic influence on the transmissibility in the frequency range between 6 Hz and 20 Hz (the sensitive frequency range for vibration transmission to hands and arms of the operator);

(b) The influence of length ratio $L_1/L_2$ is different with respect to the first and second resonant frequencies, and two small length ratios is good for a more compact structure but will result in the two resonant peaks to be closer to 20 Hz leading to a worse vibration suppression in the sensitive frequency range;

(c) The bigger mass $M_1$, smaller stiffness K, smaller assembly angle θ, and bigger layer number n will all monotonically lead to a smaller resonant frequency and thus better vibration suppression in the sensitive frequency range (6-20 Hz);

(d) Flexural material such as plastic seems better for vibration suppression but lateral stiffness would be worse to the handling capability of breakers. Therefore, lightweight aluminum seems a better choice in practice.

With the results above, it can be seen that the structure can be designed by adjusting several structural parameters to achieve good vibration suppression performance with a lower natural frequency, considering high loading capacity, large displacement motion, and avoiding the stability problem.

For example, to increase the loading capacity without changing the size of the existing device, the assembly angle of elongate members and the stiffness of springs should be increased;

to increase the compression working range, the elongate member assembly angle and the layer number of the vibration reducing assembly structure should be increased;

to reduce the natural frequency of the structure, the length ratio $L_1/L_2$, the mass $M_1$ and the layer number of the vibration reducing assembly structure should be increased; or the spring stiffness should be reduced and the elongate member assembly angle should be reduced.

It would also be appreciated that although the examples depicted include two vibration reducing assemblies, one, two or three assemblies could be used without departing from the scope of the present disclosure.

Overall, there are redundant structure parameters which can be employed to tune the vibration suppression performance to practical application, presenting excellent flexibility for achieving a range of outcomes.

Example

Based on a simple optimization to minimize the weighted transmissibility in the critical range a vibration reducing apparatus with initial parameter settings was proposed as follows:

$L_1$=100 mm, $L_2$=200 mm, $M_1$=10 kg, $M_2$=20 kg, $\theta=\pi/4$, K=100 N/mm, D=0.01 and the elongate member material is structural steel.

To optimise the parameters of this apparatus, the following parameters were selected:

$L_1$=100 mm, $L_2$=200 mm, $M_1$=15 kg, $M_2$=20 kg, $\theta=\pi/6$, K=100 N/mm, D=0.1 and the elongate member material is aluminium alloy.

Figure 5:
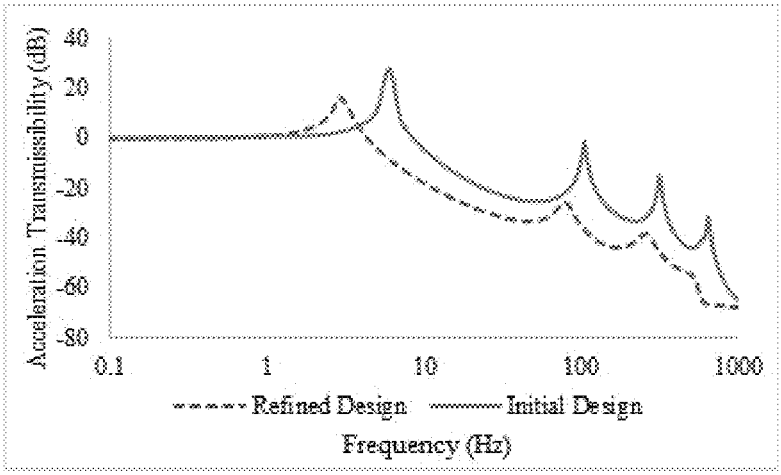
FIG. 5 depicts a comparison of the performance of the initial design and optimised design obtained by changing parameters.

The results are shown in FIG. 5, which indicates the comparison of acceleration transmissibility curves between the refined or optimized design and the initial design.

It can be seen that all the resonant frequencies (the first frequency is 3 Hz) and peak values with the optimized parameter setting are smaller than those initially (the first frequency is 6 Hz).

This is especially the case in the sensitive frequency range of vibration transmission. Specifically the maximum reduction of the transmissibility at around 6 Hz is an impressive approximately 40 dB.

Comparing the two parameter settings, it can be seen that the mass $M_1$ (i.e., the downward pushing force) and assembly angle are two critical design parameters for this performance improvement.

However, both parameters do not relate to structural size but are factors which can be controlled by operators in practice. Both parameters are related to the compression of the vibration reducing assemblies in the apparatus.

Simulation Results of Refined Design for a Complete Model

Modal analysis of the complete model of the structure is undertaken to provide an insight into the structural dynamics in real application.

Figure 6A:
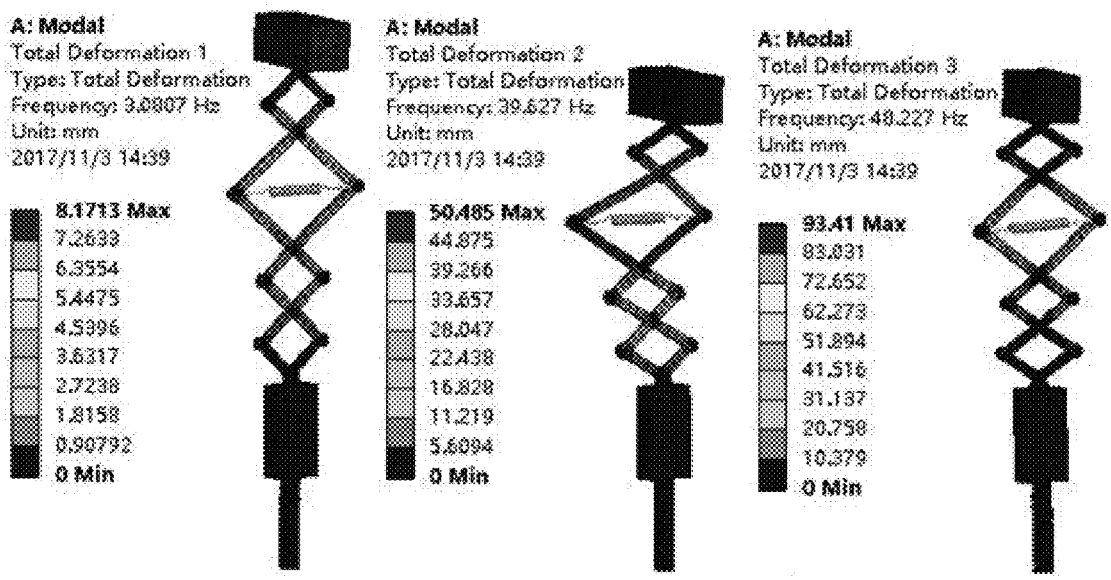
FIG. 6A depicts a modal analysis of the simplified model with one vibration reducing assembly

For comparison, the simplified model of one vibration reducing assembly depicted in FIG. 2B is analyzed first, and the modal analysis results are shown in FIG. 6A. Modal analysis of the complete model of the structure shown in FIG. 2A, with two parallel vibration reducing assemblies using the optimised parameters discussed above is then undertaken.

In FIG. 6A, it can be seen that the frequency of the first-order mode is only 3 Hz. The inherent vibration mode is an up and down motion. The angles of the elongate members are changed, but the elongate members are not deformed. It corresponds to the first peak of the acceleration transmissibility curve for the refined design in FIG. 4G or FIG. 5. The second mode (39 Hz) is not considered since the frame in the vertical direction restricts the motion. The third mode has a frequency around 48 Hz which produces deformation of the shaped structure horizontally. Making the elongate member length L2 smaller to be equal to $L_1$, will address this problem.

For all the other higher vibration modes, the influence on the handles of the structure would be very small since the frequencies are around or more than 50 Hz and the vibration amplitude would be very small.

Figure 6B:
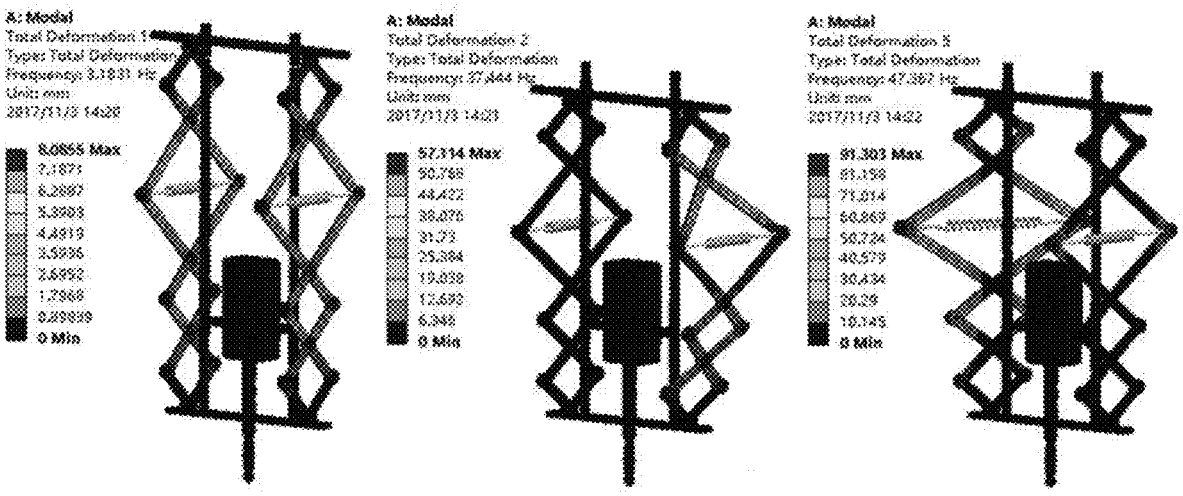
FIG. 6B depicts a modal analysis of the complete model with two vibration reducing assemblies

Referring now to FIG. 6B, there is shown the first 3 vibration modes of the complete model of the structure shown in FIG. 2A (including two vibration reducing assemblies). The modal results are basically the same as the modal results in FIG. 6A for the simplified model. The vibration mode within the system/apparatus of the present system for the mode 2 still has bending deformation horizontally as in the exemplary structure shown it is not fixed to the guide frame.

From the modal analysis above, it can be seen that (a) the mode frequencies obtained are basically consistent with the theoretical analysis of the resonant frequencies of the system; (b) the mode frequencies below 50 Hz should be considered in the parameter selection; however, due to the excellent quasi-zero stiffness of the X-shaped structure, all higher frequency vibration more than 5 Hz would be significantly suppressed; (c) There are no special low frequency mode frequencies in the sensitive frequency range 6-20 Hz for the designed system, which is very good for the predicted overall vibration suppression performance.

Finite Element Model Analysis

Considering the real percussive tool such as a road breaker working usually at a constant frequency such as 30 Hz in demolition, investigation is performed of the dynamic response of the system subject to a single-frequency excitation but with different input amplitude with a finite element model.

All structure parameters are basically the same as the real prototype (introduced later). Note that the stiffness system is nonlinear (Section 3) and thus nonlinear response would be expected to see when the excitation amplitude is large enough. This single-frequency excitation is important to understanding of the real experimental data later.

Figure 7:
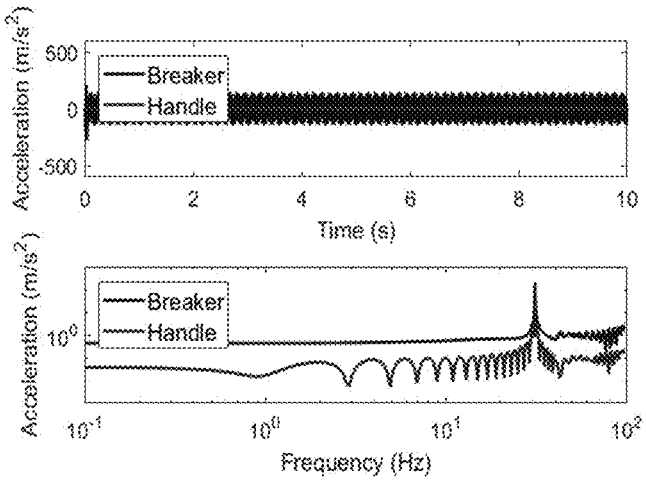
FIG. 7 depicts a simulation result of 30 Hz Single-Frequency Excitation
Figure 7:
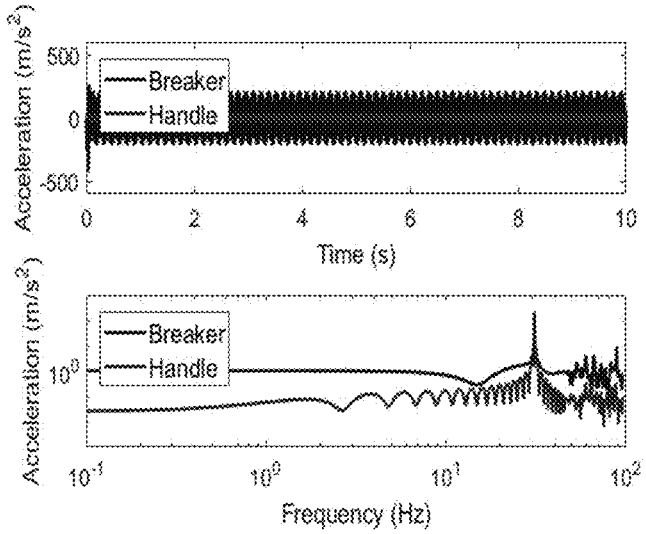
Figure 7:
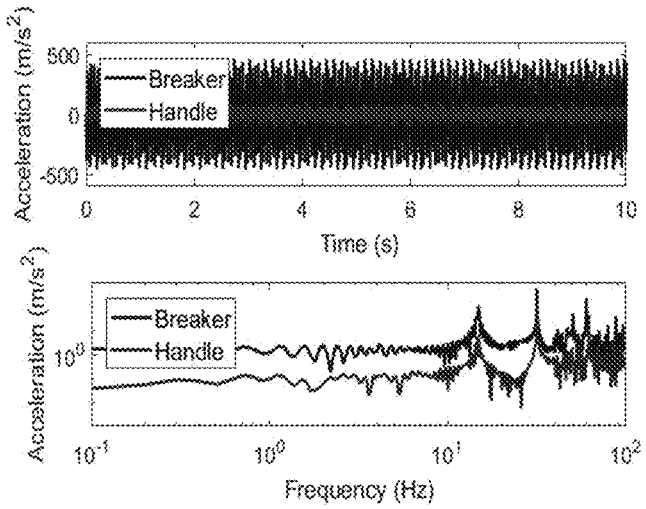
Figure 8A:
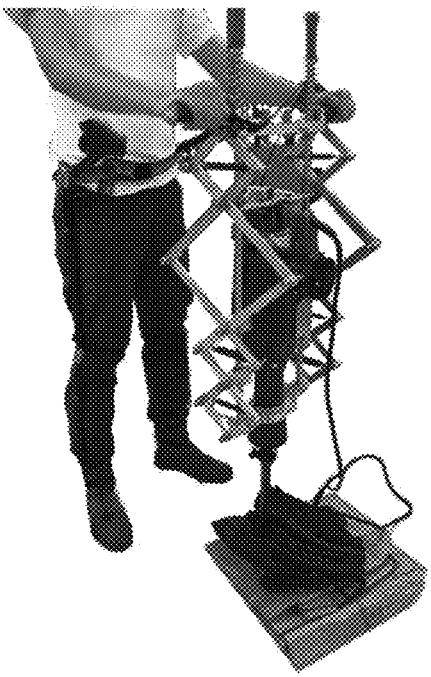
FIG. 8A depicts an experimental prototype in laboratory
Figure 8B:
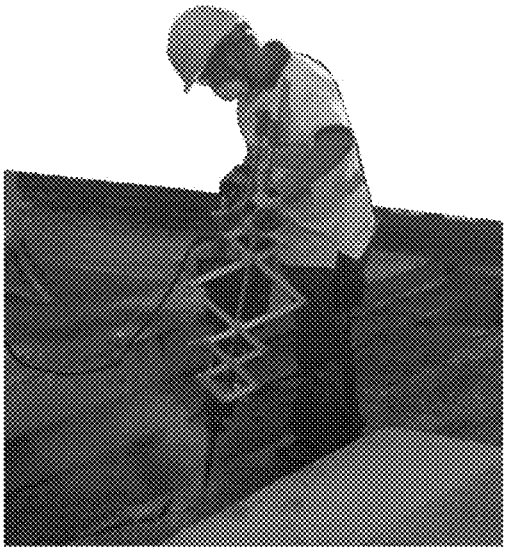
FIG. 8B depicts an experimental prototype in an onsite experiment.

FIGS. 7A-C show the time domain and corresponding frequency domain output responses of the BIAVE system under 30 Hz single-frequency excitation with different input force 2 KN, 6 KN and 10 KN.

In FIGS. 7A-C it can be seen clearly that (a) The vibration suppression performance is apparent with a vibration reduction in energy of approximately 80-90%; which is consistent with the theoretical and simulation results of the previous sections;

(b) When the excitation amplitude is large enough up to 6 KN, the output response is obviously complicated with more frequency components observed instead of a single frequency peak at 30 Hz, due to the nonlinear dynamics in the system;

(c) With increasing excitation amplitude, super-harmonic response at the frequencies (60 Hz) of two times bigger than the input frequency (30 Hz) appears and then output response tends to more complicated; For example, under the 10 KN excitation, besides the output response at 30 Hz, there are some other frequency components including the one around 60 Hz, a smaller one at around 45 Hz, and another obvious one at 15 Hz, which are corresponding to super-harmonic response, inter-modulation response and sub-harmonic response respectively; and the sub-harmonic response at 15 Hz is very strong.

Therefore, almost all nonlinear dynamics due to a single-tone excitation can be observed with a very strong sub-harmonic response, indicating that potential response of real percussive tools could be very complicated in strong excitation environments.

It should be noted that the sub-harmonic response peak at 15 Hz is exactly located within the sensitive frequency range (6-20 Hz) for a human operator and therefore a vibration suppression system of ultra-low resonant frequency is really needed for isolating this harmful vibration.

The quasi-zero stiffness of the vibration reducing assemblies of the present disclosure exactly meets this challenging requirement with a very low resonant frequency around 3 Hz and which can effectively suppress the vibration peak shown.

Measured Characteristics of an Actual Experimental Prototype

The refined parameter setting is used for the prototype as discussed above. That is, $L_1$=100 mm, $L_2$=200 nm, $M_1$=15 kg, $M_2$=20 kg, $\theta=\pi/6$, K=100 N/mm, D=0.1 and the elongate member material is aluminium alloy. Note that $M_1$ is the downward pushing force. T That is once the percussive tool (breaker) is in operation the handle of the prototype structure would be pushed down to the desired position, which is equivalent to the mass $M_1$, with an assembly angle $\theta=\pi/6$. The mass $M_2$ is exactly the mass of the percussive breaker used in experiments.

The whole structure is about one meter tall.

In the specific prototype produced according to the disclosure of the present disclosure there are two 4-layer X-shaped vibration suppression structures arranged in parallel (FIG. 2A), although it would be appreciated that other arrangements with different numbers of layers would be possible as previously discussed.

Both vibration suppression structures have 1-layer large elongate members and 3-layer small elongate members joined by corresponding rotating joints. The mass of the connecting rods is around 0.3 kg per 100 mm. The overall downward force on the handle which used to make the structure to work at the desired assembly angle is 15 kN, which follows the parameter setting used in theoretical calculation and FEM analysis. The breaker used in the prototype is 20 kg, with an impact frequency of 1800 times/min, i.e., 30 Hz.

Once the breaker is actuated, hitting the concrete or rubber generates a single-frequency excitation to the system vertically, which has a main frequency around 30 Hz on rubber or 20 Hz on concrete. The vibration acceleration signals on the breaker and on the handle of the prototype structure both can be measured for further analysis, which are referred to as Z-down and Z-up respectively.

To evaluate the vibration level, the ISO5349 standard calculation for hands and arms vibration is adopts, which is a frequency-weighted acceleration energy as shown in (33).

$$a_{hw} = \sqrt{\sum_{i=1}^{n} (K_i a_{hi})^2} \tag{33}$$

where:

n is the total number of frequency band.

$K_i$ is the weighting coefficient of No. i frequency band, the value is shown in Table 3.

$a_{hi}$ is the acceleration RMS value, the formula is as follows:

$$a_{hi} = \sqrt{\frac{1}{T}\int_0^T a^2(t)dt} = \frac{a_0}{\sqrt{2}} \tag{34}$$

where:

T is the recording time.

$a_0$ is the maximum value of vibration acceleration.

ISO 5349 proposes the frequency range including octave bands, its center frequency is from 8 to 1000 Hz, ⅓ octave bands, its center frequency is from 6.3 to 1250 Hz. The weight coefficient are shown in Table 3.

TABLE 3

Weighting coefficient of weighted acceleration under ⅓ octave bands

| Centre Frequency (Hz) | $K_i$ |
|---|---|
| 6.3 | 1.0 |
| 8.0 | 1.0 |
| 10.0 | 1.0 |
| 12.5 | 1.0 |
| 16 | 1.0 |
| 20 | 0.8 |
| 25 | 0.63 |
| 31.5 | 0.5 |
| 40 | 0.4 |
| 50 | 0.3 |
| 63 | 0.25 |
| 80 | 0.2 |
| 100 | 0.16 |
| 125 | 0.125 |
| 160 | 0.1 |
| 200 | 0.08 |
| 250 | 0.063 |
| 315 | 0.05 |
| 400 | 0.04 |
| 500 | 0.03 |
| 630 | 0.025 |
| 800 | 0.2 |
| 1000 | 0.016 |
| 1250 | 0.0125 |

Based on the calculation method above, the measured data from several experimental testing in laboratory with the breaker hitting on rubber materials are summarized in Table 4.

TABLE 4

Frequency-weighted acceleration of the prototype structure in laboratory testing

| Vibration on the breaker-Down | | Vibration on the prototype structure | $T_a$ = Vibration_up/ Vibration_down | Working Condition |
|---|---|---|---|---|
| Only Z-direction | 14.014 | 4.665 | 0.332898 | 3 spring full |
| | 13.852 | 5.13896 | 0.370988 | 4 spring no |
| | 15.469 | 6.111534 | 0.395072 | 4 spring full |
| | 13.875 | 4.306374 | 0.310350 | 5 spring no |
| | 16.619 | 5.460997 | 0.328589 | 5 spring full |
| Overall X + Y + Z 3 direction | 15.580 | 7.38699961 | 0.474128835 | 3 spring full |
| | 15.253 | 8.10176862 | 0.53114292 | 4 spring no |
| | 16.791 | 8.29026793 | 0.493730044 | 4 spring full |
| | 14.713 | 7.61053066 | 0.517235251 | 5 spring no |
| | 17.623 | 8.24978376 | 0.468108553 | 5 spring full |

In Table 4, the following parameters should be considered different springs have different stiffness coefficients (K); no loading means that the pushing down force is the weight of the prototype structure itself;

full loading means that the ideal 15 kg downward force is applied.

The following points can be drawn from Table 4:

(i) The vibration on the breakers is about 14 m/s$^2$, while on the handles it is only about 5 m/s$^2$. The vibration reduction is very significant (up to 70%), and the suppressed vibration level means that the workers can continuously work up to 5 or 8 hours in comparison to the situation without the structure where the workers can only work about 30 mins.

(ii) When more downward pushing force is applied, the vibration on the breaker is much higher indicating more powerful demolition; but the vibration level on the prototype handles are maintained at a relatively reasonably healthy level with a similar reduction in the overall vibration (there is no significant apparent increase in this despite the increased downward force).

(iii) The addition of more springs in the prototype system can enable more downward pushing force with the same compression level, although the corresponding vibration level on the handles increases (not uniformly due to variation in the hitting surface during testing).

(iv) The overall vibration of all 3 directions has no significant difference from and follows a similar trend to the vibration in the Z-direction since the vibration in the Z-direction dominates. It is much clearer that more springs lead to more vibration energy absorbed from the breaker while lower vibration transmissibilities can be seen in each case comparing the full-loading and no-loading cases, showing again the unique nonlinear stiffness property of the disclosed structures.

Table 5 summarizes the different testing results by calculating the root-mean-square of the measured vibration signals.

TABLE 5

RMS of acceleration signals in laboratory testing

| Z Down | Z Up | $T_a$ = Z_up/Z_down | Working Condition |
|---|---|---|---|
| 279.0656823 | 45.36138 | 0.16254736 | 3 spring full loading |
| 275.711242 | 57.50320 | 0.20856314 | 4 spring no loading |
| 313.633182 | 64.42959 | 0.20542979 | 4 spring full loading |
| 275.2987827 | 39.62296 | 0.14392714 | 5 spring no loading |
| 334.0796643 | 52.88027 | 0.15828642 | 5 spring full loading |

Table 5 summarises the overall vibration suppression in terms of vibration energy transmitted from the breaker to the prototype handles.

It can be clearly seen that up to 80% or more vibration energy is suppressed in all cases, and more springs lead to more vibration energy on the breaker which is helpful for demolition efficiency, while similar vibration transmissibilities can be seen in each case comparing the full-loading and no-loading cases. This clearly shows that the unique nonlinear quasi-zero stiffness of the system of the present disclosure.

Figure 9:
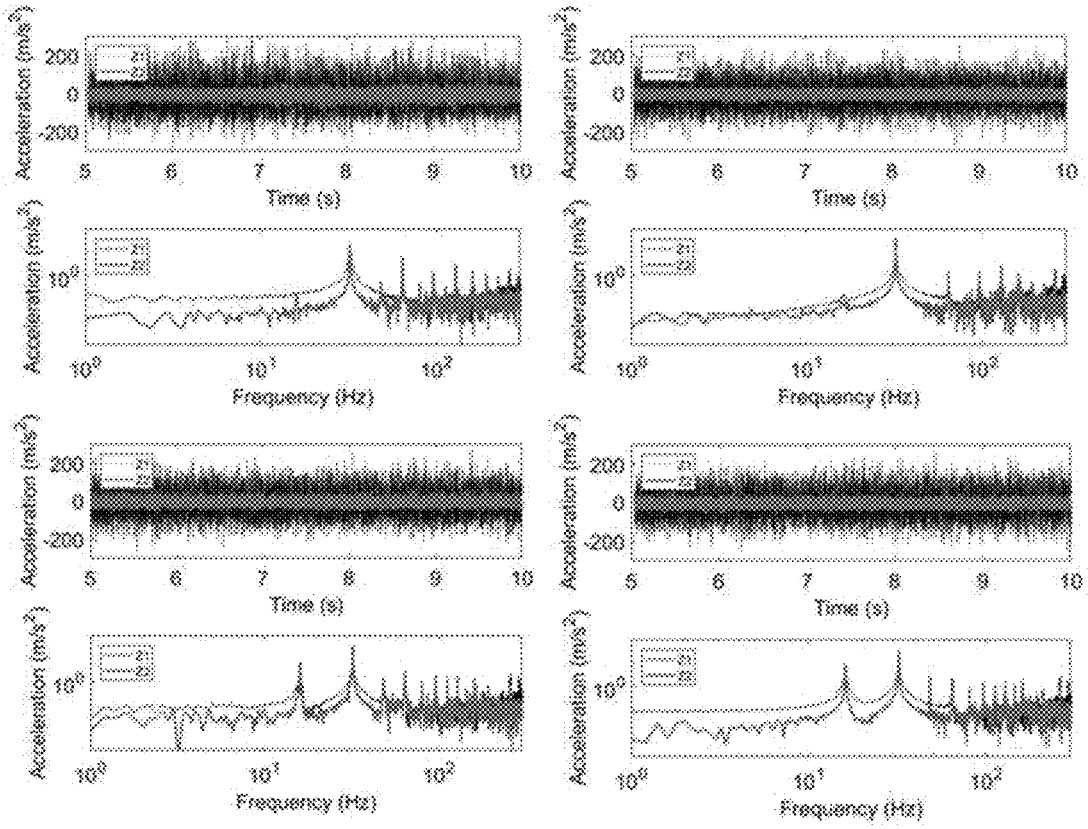
FIG. 9 depicts time and frequency responses in typical laboratory testing (Z1 is the vibration on the percussive breaker and Z2 is the vibration on the handle of the vibration reducing apparatus)
Figure 10A:
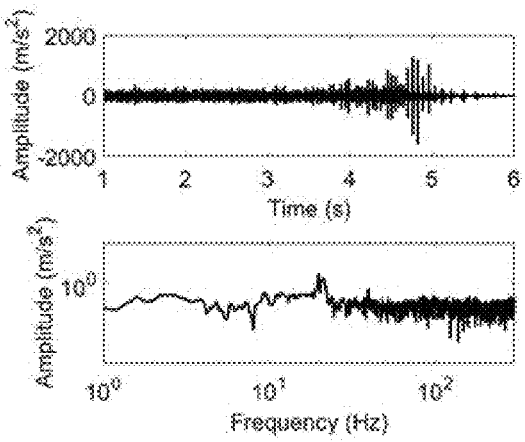
FIG. 10A depicts acceleration signals in time and frequency domains for a traditional breaker on direction Z.
Figure 10B:
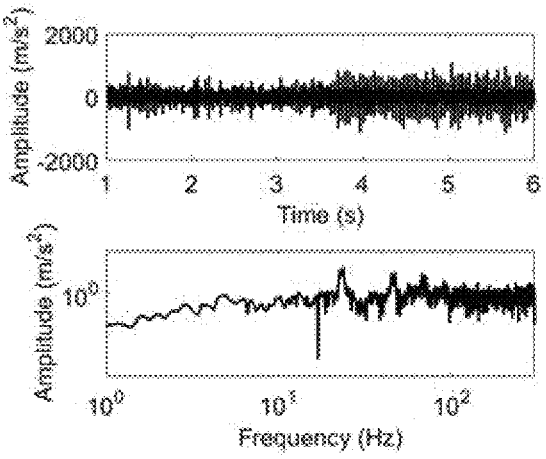
FIG. 10B depicts acceleration signals in time and frequency domains for the bottom of an apparatus of the present disclosure with a breaker on direction Z.
Figure 10C:
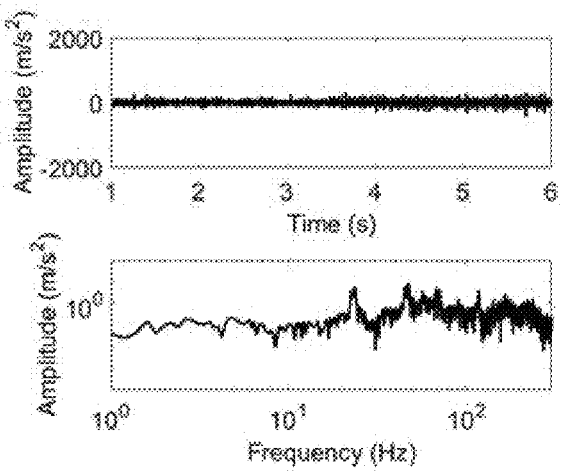
FIG. 10C depicts acceleration signals in time and frequency domains for the top of the apparatus on direction Z.
Figure 10D:
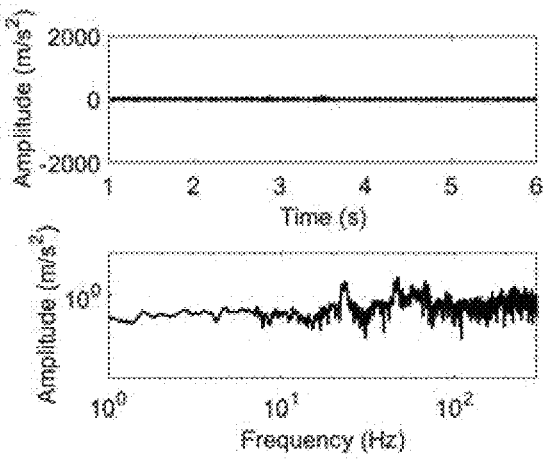
FIG. 10D depicts acceleration signals in time and frequency domains for the handle of the apparatus on direction Z.

FIG. 9 shows some time and frequency response for the above test results.

The results are summarized or shown in Table 6 and FIG. 9.

It can be seen that the main excitation comes from the vibration frequency of the breaker (around 30 Hz), and there is an obvious vibration peak around 30 Hz. The vibration suppression between 6 Hz and 20 Hz is very good in each test case.

Complicated nonlinear dynamic response can be seen exactly as the analytical analysis before, including super-harmonics, sub-harmonics and intermodulation.

In some cases, the sub-harmonic response is very strong (around 15 Hz) which can be seen both on the breaker and the handles of the structure of the present disclosure due to the coupling dynamics between the structure and the breaker, but still has obvious suppression.

It can be seen that with the apparatus, the vibration on the breaker ($Z_1$) is higher than that without the apparatus (improved up to 75% in terms of overall vibration energy or 30% for the weighted vibration). This would be understood by a person skilled in the art to reflect improved demolition efficiency.

However, it can also be seen that with the apparatus/structure of the disclosure, the vibration at the handle ($Z_2$) is suppressed significantly as compared to the traditional breaker Z to a much healthier level according to the ISO hand-arm vibration standard.

TABLE 6

On-site vibration testing of the disclosed structure and Traditional Breaker

| | Apparatus + breaker $Z_1$ | Apparatus Handle | Traditional Road |
|---|---|---|---|
| Frequency-weighted acceleration | 17.7296 ± 0.5651 | 6.8486 ± 0.4495 | 13.6950 ± 0.2414 |
| Root mean square | 1072.035 ± 11.4868 | 416.7246 ± 28.4300 | 612.856 ± 88.0166 |

FIG. 10-A-D shows one typical testing result, where "traditional Z" refers to the vibration on the traditional percussive tool (in this case a road breaker) without the disclosed apparatus and system, while the "down, up and hand" refer to the vibration on the tool body, apparatus and system handle and operator hand with the apparatus and system, respectively. As can be seen from these figures, the vibration suppression performance provided by the apparatus and system is very significant, in terms of the overall vibration energy and the vibration within the sensitive frequency range 6-20 Hz.

The nonlinear stiffness of the vibration reduction assembles enables a purely passive vibration reducing apparatus and system. Mathematical modelling, FEM analysis and experimental validation shows this is very effective for vibration suppression up to 70% or above and can significantly reduce the vibration transmitted from percussive tools to operator handles. The system and apparatus of the present disclosure successfully solves vibration issues caused by manually manipulating various construction tools for many years.

The nonlinear stiffness characteristics is very beneficial for passive vibration control, including the following several unique features simultaneously: (1) quasi-zero stiffness, (2) high loading capacity, (3) decreasing stiffness with increasing compression of the structure, (4) flexible & easy to implement, and (5) adjustable structural parameters.

These features enable the apparatus/system to be very effective and efficient in suppression of excessive vibration transmitted to operator hands during manipulating various percussive demolition tools in the construction field, without affecting the handling comfort. At the same time, as significantly reducing the vibration transmission to operators (up to 70% or 90% in different cases), the system can improve the demolition efficiency (up to 30% in terms of weighted vibration energy).

Figure 11A:
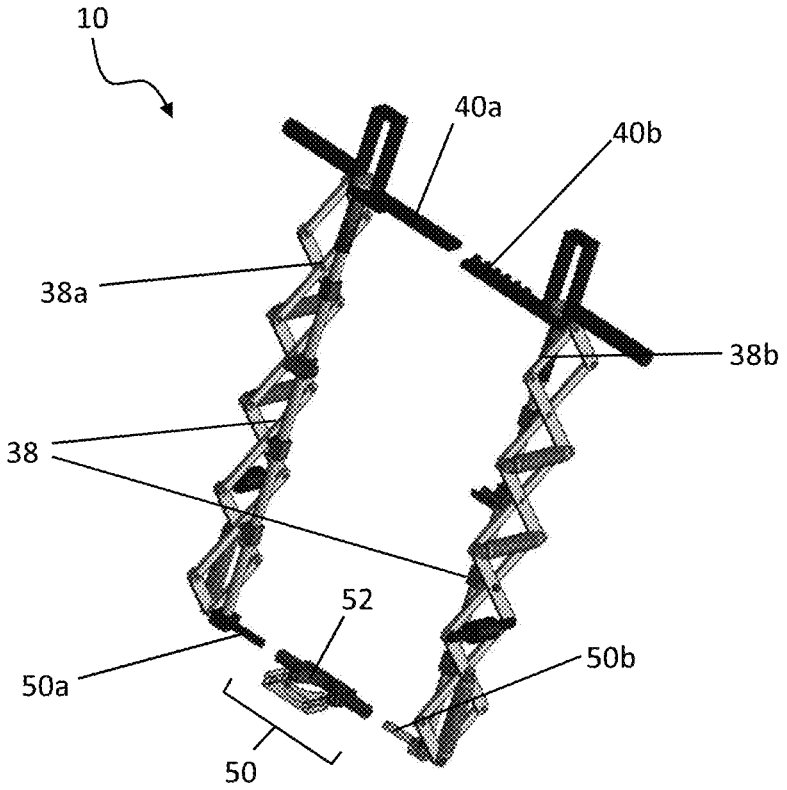
FIG. 11A depicts the schematic representation of FIG. 1A in expanded form with the jackhammer removed for the purposes of clarity, showing an optional adjustable width frame for engaging different jackhammer models.
Figure 11B:
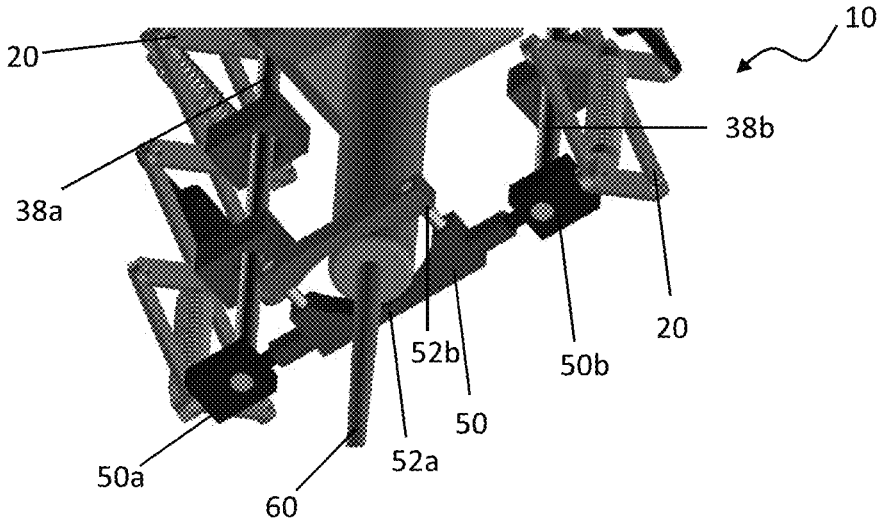
FIG. 11B depicts an exemplary schematic representation of an enlarged view of one exemplary embodiment of the engagement of the jackhammer with the frame.

Referring now to FIG. 11A, there is depicted an exploded view of the vibration reducing apparatus showing in FIG. 1A. In this embodiment, the handle 40 is formed in two pieces 40*a* and 40*b*, allowing for adjustment of the spacing between the guide members 38*a*, 38*b* of the frame 38. Similarly, the bottom member which receives the jackhammer or reciprocating tool 60 is comprised of a plurality of length adjustable member 50*a* and 50*b* together with a central receiving portion 52. Referring now to FIG. 11B, it can be seen that this Figure depicts an exploded view of the transversely extending member 50 which maintains the guide rods 38*a*, 38*b* in a spaced apart orientation.

The member 50 advantageously is comprised of attachment members 50*a* and 50*b* which are attached to the guide means 38*a*, 38*b* and the vibration reducing assemblies 20.

The centre portion of the transversely extending member 50 is advantageously comprised of a clamp, formed by clamping component 52*a* and 52*b*. These clamping components receive a reciprocating tool such as a jackhammer or road breaker or hammer drill. It would be appreciated that the arrangement depicted is merely exemplary, and other arrangements would maintain the percussive reciprocating tool in the desired orientation would be possible. As shown, there may also be engagement means which slidably attach the vibration assemblies at one or more points along the guide frame.

Figure 11C:
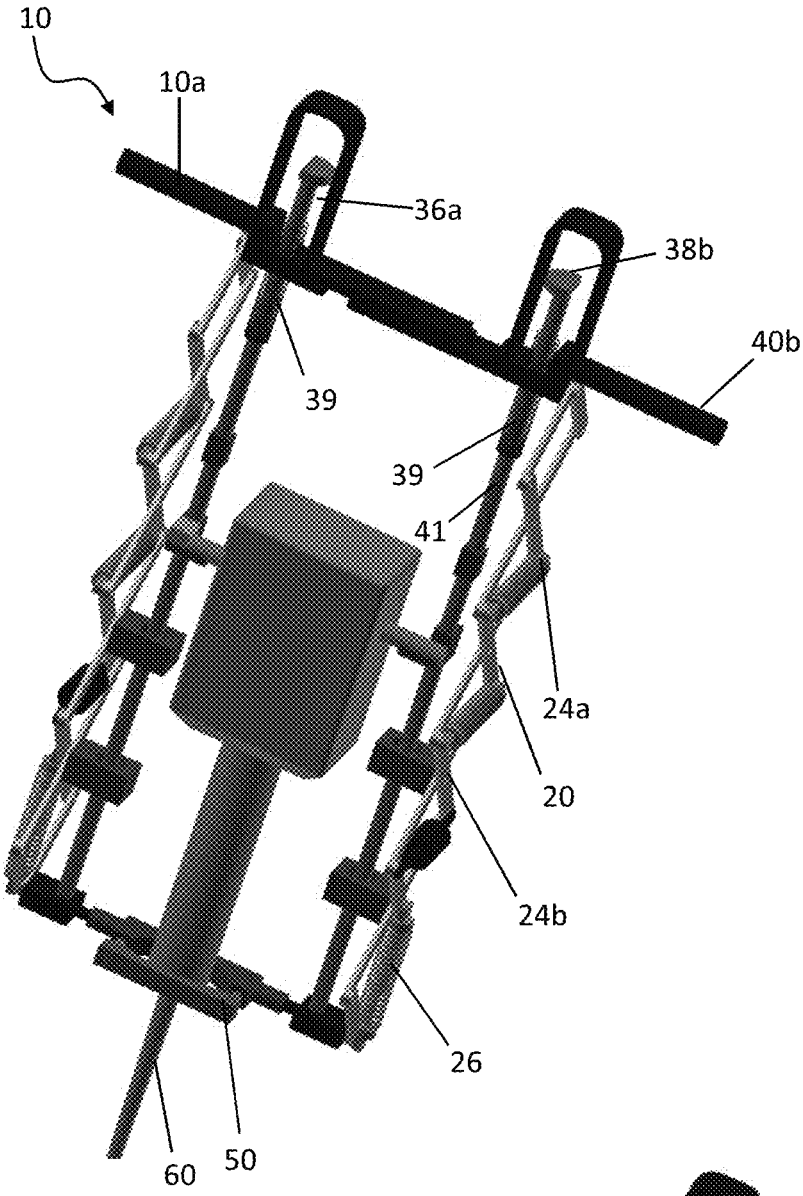
FIG. 11C depicts another exemplary embodiment showing further optional features for restricting possible motion.
Figure 11D:
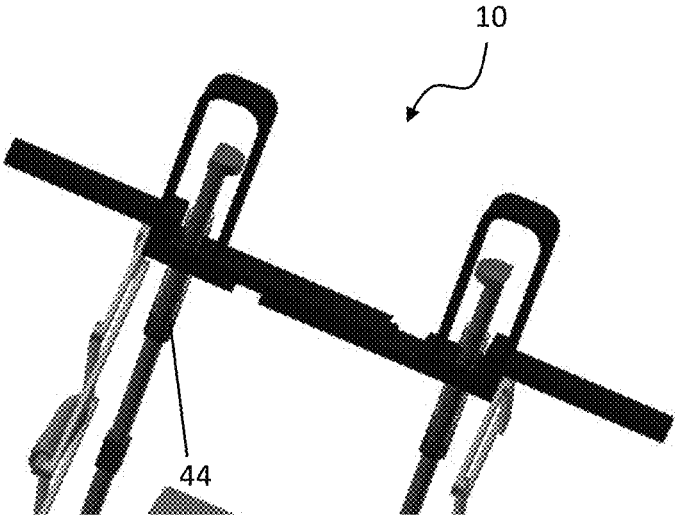
FIG. 11D depicts an expanded view of the handles in the embodiment depicted in FIG. 11C.

Referring now to FIG. 11C, there is depicted a further embodiment of the vibration reducing apparatus of FIG. 1A. Advantageously, it can be seen that the handle 40 is comprised of components 40*a* and 40*b* which are movable with respect to each other to adjust the spacing between the guide members 38*a* and 38*b*. The handle is supported on the guide member 38*a* such that it can move on the guide members on a biasing means or spring 39. The spring is supported on the stop 41 which defines the maximum amount of travel permitted for the handle 40.

Advantageously for safety reasons, the handle may be shaped as shown with an upwardly extending guide which contains the end of guide means to avoid impaling the operator.

It can be seen also that the jackhammer or road breaker 60 is attached such that the axis of reciprocation of the tool is generally aligned with the guide means 38*a*, 38*b*. Typically these are between 50-120 cm in length and around 30-80 cm in width, although these parameters can of course be adjusted based upon the reciprocating tool which is constrained therein.

In the embodiment depicted in FIG. 11C, the biasing means or spring 24*a*, 24*b* of the vibration reducing assemblies 20 extend transversely between the ends of the elongate members. There is an additional spring 26 aligned in a direction of the axis of reciprocation which may provide some limited damping.

As would be appreciated by a person skilled in the art to operate the vibration reducing apparatus of the present disclosure, the operator would apply a load to the handle 40. This load compresses the handle spring 39 until it reach the stop 41. At the same time, during operation a reciprocating motion is being generated by the percussive tool (jackhammer 60 supported on the guide frame 38*a* and 38*b*).

The force provided by the operator is transmitted via the vibration assemblies 20 down to the end or point of the working tool 60 via the engagement with the transverse member 50.

As has been discussed in detail in the foregoing, the non-linear stiffness characteristic of the vibration reducing apparatus under load advantageously isolates the operator's hands which have been placed on the handle from significant amount of vibration in the pre-determined vibration range, for which various parameters of the apparatus may be customised as discussed.

The above embodiments are described by way of example only. Many variations are possible without departing from the scope of the disclosure as defined in the appended claims.

The invention claimed is:

1. A vibration reducing apparatus for a percussive tool having a working member which reciprocates along an axis of reciprocation, the apparatus comprising:

a guide frame configured for retaining the percussive tool, the guide frame comprising at least 5 two elements extending along and at least one member extending across the axis of reciprocation when the percussive tool is retained therein, an assembly extending in a direction of along the axis of reciprocation wherein said assembly comprises at least two layers, each layer comprising four interconnected elongate members pivotally attached and rotatable with respect to each other to define a polygon; wherein the assembly has at least one biasing means extending between the ends of at least one pair of elongate interconnected members of a layer and wherein said assembly is displaceable in the direction of along the axis of reciprocation;

a handle movably coupled to the guide frame and supported on the assembly for transmission of an applied load down and along the assembly;

wherein the arrangement of the at least one biasing means relative to the elongate members provides decreasing stiffness with increasing compression of the assembly under an applied load to the handle for reducing vibration thereof in a predetermined frequency range.

2. The vibration reducing apparatus according to claim 1 comprising one or more further assemblies spaced apart from the assembly, wherein each assembly is attached at one end thereof to the at least one member extending across the axis of reciprocation.

3. The vibration reducing apparatus according to claim 1 wherein one or more parameters of the or each assembly are modified for achieving one or more of a lower natural resonance frequency relative to a percussive tool without the vibration reducing apparatus; increased loading capacity; a predetermined displacement distance of the at least one or more further assemblies along the axis of reciprocation and size of the at least one or more further assemblies in an unloaded state.

4. The vibration reducing apparatus according to claim 3 wherein one or more of the modified parameters of the or each assembly are selected from the group comprising spring stiffness, the angle between elongate members, the material of the elongate members, the ratio of lengths of elongate members to each other, and the number of layers.

5. The vibration reducing apparatus according to claim 1 wherein the stiffness of the at least one biasing means is adjustable for changing the resonant frequency of the apparatus.

6. The vibration reducing apparatus according to claim 5 wherein the stiffness of the at least one biasing means is adjusted by substitution with one or more biasing means having a different stiffness to the at least one biasing means.

7. The vibration reducing apparatus according to claim 5 wherein the stiffness of the at least one biasing means is adjusted by the addition or removal of one or more biasing means.

8. The vibration reducing apparatus according to claim 1 wherein the angle between adjacent elongate members is adjustable so as to modify the vibration suppression provided by the or each assembly.

9. The vibration reducing apparatus according to claim 1 wherein the material of the elongate members is selected so as to have a reduced stiffness relative to steel.

10. The vibration reducing apparatus according to claim 9 wherein the material of the elongate members is aluminium or magnesium.

11. The vibration reducing apparatus according to claim 1 wherein two or more elongate members of the apparatus have a first length; and wherein the other elongate members of the apparatus have a second length; wherein the relative ratio of the first length to the second length is selected to provide vibration suppression in the apparatus in the predetermined frequency range of 6-20 Hz.

12. The vibration reducing apparatus according to claim 1, wherein the angle between the elongate members and/or the stiffness of the at least one biasing means are adjustable so as to maintain the physical size of the apparatus with an increase in the operator applied load.

13. The vibration reducing apparatus according to claim 1, wherein the elongate member angle and number of layers in the or each assembly is adjusted so as to modify the possible amount of displacement of the or each assembly in the direction of along the axis of reciprocation.

14. The vibration reducing apparatus according to claim 1, wherein the or each assembly are attached to the guide frame at one or more regions distal to the ends of the guide frame for resisting non-vertical deformation under load.

15. The vibration reducing apparatus according to claim 1 wherein the or each assembly is configured to reduce vibration transmission from a percussive tool receivable therein in the predetermined frequency range of 6-20 Hz.

16. The vibration reducing apparatus according to claim 1 wherein at least two of the elongate members are pivotally interconnected with each other at a location distal from the ends thereof.

17. The vibration reducing apparatus according to claim 1, wherein the maximum travel of the movably supported handle on the guide member is fixed by stops on the guide frame.

18. The vibration reducing apparatus according to claim 1 wherein the handle and at least one member extending across the guide frame are adjustable so as to increase the distance between the at least one or more further assemblies and the at least one assembly.

19. The vibration reducing apparatus according to claim 1 wherein the handle is supported on the frame by a biasing means arranged to extend in a direction of along the axis of reciprocation of the working member of the tool.

20. The vibration reducing apparatus according to claim 1 wherein the at least one member extending across the axis of reciprocation for retaining the powered percussive tool in the guide frame is an adjustable clamp.

21. The vibration reducing apparatus according to claim 1 wherein the lengths of elongate members are substantially the same.

22. The vibration reducing apparatus according to claim 1 wherein at least one pair of intersecting elongate members are arranged asymmetrically about the axis of reciprocation.

23. The vibration reducing apparatus according to claim 1 wherein the tool retained in the guide frame is selected from a group of percussive tools comprising a jackhammer, road breaker and hammer drill.

24. A vibration assembly of a vibration reducing apparatus for a percussive tool having an axis of reciprocation, the vibration assembly comprising:

at least two layers, each layer comprising four interconnected elongate members pivotally attached and rotatable with respect to each other to define a closed loop; the assembly being displaceable in the direction of along the axis of reciprocation and wherein the at least one assembly has at least one biasing means extending between the ends of at least one pair of elongate interconnected members of a layer;

wherein the assembly is configured for engagement with one element of a guide frame comprising at least two elements extending along the axis of reciprocation of the tool and at least one member extending across the axis of reciprocation wherein said at least one member is configured to retain the powered percussive tool in the guide frame;

wherein the assembly is configured for supporting at least one part of a handle movably coupled to the guide frame for transmission of force to the percussive tool and wherein the arrangement of the at least one biasing means relative to the elongate members provides decreasing stiffness with increasing compression of the assembly under an applied load to the handle for reducing vibration thereof in a predetermined frequency range of 6-20 Hz.

25. A method of using the vibration reducing apparatus according to claim 1 with a tool selected from the group of percussive tools comprising a jackhammer, road breaker and hammer drill.

* * * * *